US012735758B2

(12) United States Patent
Matsumoto et al.

(10) Patent No.: US 12,735,758 B2
(45) Date of Patent: Sep. 15, 2026

(54) HIGH-STRENGTH HOT ROLLED STEEL SHEET AND METHOD FOR PRODUCING THE SAME, AND HIGH-STRENGTH ELECTRIC RESISTANCE WELDED STEEL PIPE AND METHOD FOR PRODUCING THE SAME

(71) Applicant: JFE Steel Corporation, Tokyo (JP)

(72) Inventors: Akihide Matsumoto, Tokyo (JP); Shinsuke Ide, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 434 days.

(21) Appl. No.: 18/289,264

(22) PCT Filed: Apr. 11, 2022

(86) PCT No.: PCT/JP2022/017541
§ 371 (c)(1),
(2) Date: Nov. 2, 2023

(87) PCT Pub. No.: WO2022/239591
PCT Pub. Date: Nov. 17, 2022

(65) Prior Publication Data

US 2024/0254583 A1 Aug. 1, 2024

(30) Foreign Application Priority Data

May 14, 2021 (JP) ..... 2021-082066

(51) Int. Cl.
*C21D 8/0221* (2026.01)
*B21C 37/08* (2006.01)
(Continued)

(52) U.S. Cl.
CPC ..... *C21D 8/0226* (2013.01); *B21C 37/08* (2013.01); *C21D 8/0263* (2013.01); *C21D 9/46* (2013.01);
(Continued)

(58) Field of Classification Search
CPC ..... C21D 8/0226; C21D 8/0263; C21D 9/46; C21D 2211/002; C21D 2211/005;
(Continued)

(56) References Cited

U.S. PATENT DOCUMENTS

2022/0010418 A1 1/2022 Koh et al.

FOREIGN PATENT DOCUMENTS

CN 105102662 A 11/2015
CN 107406933 A 11/2017
(Continued)

OTHER PUBLICATIONS

JP2020012168A Translation (Year: 2020).*
(Continued)

*Primary Examiner* — Danielle M. Carda
(74) *Attorney, Agent, or Firm* — Buchanan Ingersoll & Rooney PC

(57) ABSTRACT

Provided are a high-strength hot rolled steel sheet and a high-strength electric resistance welded steel pipe and methods for producing the same. In the steel microstructure of the steel sheet at the thickness center of the steel sheet, the volume fractions of bainite and ferrite are specific values, the average grain size is 9.0 μm or less, and the dislocation density is $1.0\times10^{14}$ $m^{-2}$ or more and $1.0\times10^{15}$ $m^{-2}$ or less. In the steel microstructure at a position 0.1 mm below the surface, the volume fractions of bainite and ferrite are specific values, the average grain size is 9.0 μm or less, the dislocation density is $5.0\times10^{14}$ $m^{-2}$ or more and $1.0\times10^{15}$ $m^{-2}$ or less, and the maximum low angle grain boundary density is $1.4\times10^{6}$ $m^{-1}$ or less. The thickness of the steel sheet is 15 mm or more.

8 Claims, 1 Drawing Sheet

(51) Int. Cl.

| | |
|---|---|
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/002* (2013.01); *C21D 2211/005* (2013.01)

(58) Field of Classification Search
CPC ... C21D 8/10; C21D 1/02; C21D 1/22; C21D 7/10; C21D 8/02; C21D 9/08; C21D 8/0236; C21D 2211/001; B21C 37/08; C22C 38/001; C22C 38/002; C22C 38/02; C22C 38/04; C22C 38/06; C22C 38/12; C22C 38/14; C22C 38/08; C22C 38/16; C22C 38/22; C22C 38/24; C22C 38/26; C22C 38/28; C22C 38/32; C22C 38/38; C22C 38/58; C22C 38/42; C22C 38/44; C22C 38/46; C22C 38/48
USPC ..... 148/602
See application file for complete search history.

(56) References Cited

FOREIGN PATENT DOCUMENTS

| | | | | |
|---|---|---|---|---|
| EP | 2 987 887 | A1 | | 2/2016 |
| EP | 3 263 731 | A1 | | 1/2018 |
| EP | 3 556 889 | A1 | | 10/2019 |
| EP | 4 036 256 | A1 | | 8/2022 |
| JP | 2010-174343 | A | | 8/2010 |
| JP | 2010196160 | A | | 9/2010 |
| JP | 2012-172258 | A | | 9/2012 |
| JP | 2017179482 | A | | 10/2017 |
| JP | 2018168441 | A | | 11/2018 |
| JP | 2020012168 | A | * | 1/2020 |
| JP | 2020063500 | A | | 4/2020 |
| WO | 2015030210 | A1 | | 3/2015 |
| WO | 2020067210 | A1 | | 4/2020 |
| WO | 2020085888 | A1 | | 4/2020 |
| WO | 2020178943 | A1 | | 9/2020 |
| WO | 2021/085036 | A1 | | 5/2021 |

OTHER PUBLICATIONS

International Search Report and Written Opinion for International Application No. PCT/JP2022/017541, dated Jun. 28, 2022, 5 pages.

Kumagai et al., "Microstructural Features of Cold-Rolled Carbon Steel Evaluated by X-ray Diffraction Line Profile Analysis and Their Correlation with Mechanical Properties", ISIJ International, 2014, vol. 54, No. 1, pp. 206-211.

Unger et al., "The effect of dislocation contrast on x-ray line broadening: A new approach to line profile analysis", Appl. Phys. Lett., Nov. 18, 1996, 69(21), pp. 3173-3175.

Office Action (The First Office Action) issued Nov. 15, 2025, by the State Intellectual Property Office of People's Republic of China in corresponding Chinese Patent Application No. 202280033740.8 and an English translation with Concise explanation of relevance of the Office Action. (15 pages).

Extended European Search Report issued Dec. 3, 2024, by the European Patent Office in corresponding European Patent Application No. 22807294.8-1103. (8 pages).

* cited by examiner

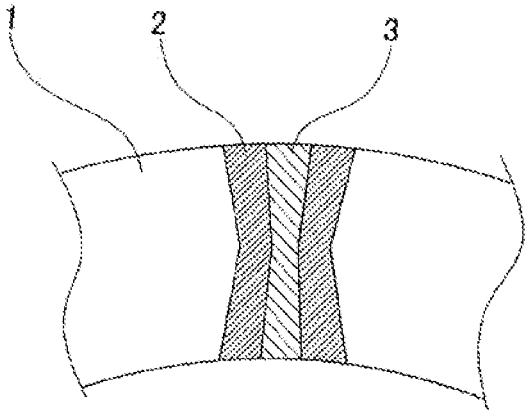
1
2
3

HIGH-STRENGTH HOT ROLLED STEEL SHEET AND METHOD FOR PRODUCING THE SAME, AND HIGH-STRENGTH ELECTRIC RESISTANCE WELDED STEEL PIPE AND METHOD FOR PRODUCING THE SAME

CROSS REFERENCE TO RELATED APPLICATIONS

This is the U.S. National Phase application of PCT/JP2022/017541, filed Apr. 11, 2022, which claims priority to Japanese Patent Application No. 2021-082066, filed May 14, 2021, the disclosures of these applications being incorporated herein by reference in their entireties for all purposes.

FIELD OF THE INVENTION

The present invention relates to a high-strength hot rolled steel sheet that can be suitably used as a material for line pipes or the like and a method for producing the high-strength hot rolled steel sheet. The present invention also relates to a high-strength electric resistance welded steel pipe that can be suitably used as a line pipe or the like and a method for producing the high-strength electric resistance welded steel pipe.

BACKGROUND OF THE INVENTION

Steel pipes for line pipes used for transporting crude oils, natural gases, or the like over great distances are required to have a high strength in order to increase transport efficiency by increasing the pressure of the inside fluid.

The steel pipes for line pipes are also required to have high resistance to sulfide stress corrosion cracking (SSC), because the inner surfaces of the steel pipes for line pipes are brought into contact with a highly corrosive fluid including hydrogen sulfide.

In general, the higher the strength of a steel material, the lower the SSC resistance of the steel material. It is particularly important for the steel pipes for line pipes to reduce the hardness (strength) of the inner surfaces of the steel pipes, which come into contact with fluids, in order to maintain certain SSC resistance.

A thermo-mechanical control process (TMCP), which is the combination of controlled rolling and accelerated cooling, is used in the production of raw-material sheets of the steel pipes for high-strength line pipes.

In TMCP, it is important to increase the cooling rate at which the accelerated cooling is performed. However, since the cooling rate of the surface of a steel sheet is higher than the cooling rate of the inside of the steel sheet, if the thickness of a steel sheet is large, the hardness of the surface of the steel sheet may be excessively increased disadvantageously. Therefore, it has been difficult to apply steel sheets produced by common TMCP to line pipes in consideration of SSC resistance.

In order to address the above-described issues, for example, Patent Literatures 1 to 3 propose a steel sheet or pipe having a controlled surface hardness.

PATENT LITERATURE

PTL 1: Japanese Unexamined Patent Application Publication No. 2020-63500

PTL 2: Japanese Unexamined Patent Application Publication No. 2020-12168

PTL 3: Japanese Unexamined Patent Application Publication No. 2017-179482

SUMMARY OF THE INVENTION

However, even in the case where the hardness of the surface of a steel sheet or pipe is controlled as in Patent Literatures 1 to 3 above, a high-stress region may locally occur in some crystal grains or in the vicinity of some grain boundaries, which acts as an origin of SSC, and a sufficient degree of SSC resistance may fail to be achieved consequently.

Note that the term "high-stress region" above refers to a portion in which dislocation density is locally high. Since a high-stress region is a microscopic region, it has been difficult to determine a high-stress region by a hardness test, such as a Vickers test, because of averaging between the high-stress region and a low-stress region present on the periphery of the high-stress region.

The present invention was made in light of the above circumstances. An object according to aspects of the present invention is to provide a high-strength hot rolled steel sheet that can be suitably used as a material for high-strength electric resistance welded steel pipes having excellent SSC resistance and a method for producing the high-strength hot rolled steel sheet, and a high-strength electric resistance welded steel pipe having excellent SSC resistance and a method for producing the high-strength electric resistance welded steel pipe.

The expression "high strength" used in accordance with aspects of the present invention means that the yield strength of the hot rolled steel sheet or the base metal zone of the electric resistance welded steel pipe which is measured in the tensile test described below is 400 MPa or more.

The expression "excellent SSC resistance" used in accordance with aspects of the present invention means that, in the four-point bending corrosion test described below, cracking does not occur in the hot rolled steel sheet or the base metal zone of the electric resistance welded steel pipe, the depths of the pitting corrosions are less than 250 μm, and the maximum (depth/width) of the pitting corrosions is less than 3.0.

The above tests can be conducted by the methods described in Examples below.

A number of low angle grain boundaries are present in a portion in which dislocation density is locally high. This is because, when a number of dislocations are present, the dislocations are aligned with one another to form a stable structure and, consequently, low angle grain boundaries are formed. However, even when the dislocations form a stable structure, a stress field created by the dislocations still remains. Therefore, a portion in which a number of low angle grain boundaries are present, that is, a portion in which the low angle grain boundary density is high, has a high stress.

Thus, for enhancing the SSC resistance of a steel sheet, it is necessary to prevent a portion in which the low angle grain boundary density is locally high from being created in the surface of the steel sheet.

The inventors of the present invention conducted extensive studies and consequently found the following facts.

Specifically, the inventors found that, even in the case where the steel sheet is a thick steel material having a thickness of 15 mm or more, performing accelerated cooling of a hot rolled steel sheet in two stages and controlling the temperatures of the surface and inside of the steel sheet and the cooling rates of the surface and inside of the steel sheet during the cooling step and the time interval between the two cooling steps in an appropriate manner reduces the likelihood of a portion in which the low angle grain boundary density is locally high being created in the surface of the steel sheet and consequently enhances SSC resistance. The inventors also found that the SSC resistance of an electric resistance welded steel pipe produced using the above steel sheet as a raw material can be enhanced by the same action as described above.

Aspects of the present invention are made on the basis of the above knowledge. The summary of aspects of the present invention is as follows.

[1] A high-strength hot rolled steel sheet, wherein:

in a steel microstructure of the high-strength hot rolled steel sheet at the center of the steel sheet in a thickness direction of the steel sheet, a volume fraction of bainite is 50% or more, a total volume fraction of ferrite and bainite is 95% or more, with the balance being one or more selected from pearlite, martensite, and austenite, an average grain size is 9.0 μm or less, and a dislocation density is $1.0\times10^{14}$ $m^{-2}$ or more and $1.0\times10^{15}$ $m^{-2}$ or less;

in a steel microstructure of the high-strength hot rolled steel sheet at a position 0.1 mm below a surface of the steel sheet in a depth direction of the steel sheet, a volume fraction of bainite is 70% or more, a total volume fraction of ferrite and bainite is 95% or more, with the balance being one or more selected from pearlite, martensite, and austenite, an average grain size is 9.0 μm or less, a dislocation density is $5.0\times10^{14}$ $m^{-2}$ or more and $1.0\times10^{15}$ $m^{-2}$ or less, and a maximum low angle grain boundary density is $1.4\times10^{6}$ $m^{-1}$ or less; and a thickness of the high-strength hot rolled steel sheet is 15 mm or more.

[2] The high-strength hot rolled steel sheet according to [1], having a chemical composition containing, by mass, C: 0.020% or more and 0.15% or less, Si: 1.0% or less, Mn: 0.30% or more and 2.0% or less, P: 0.050% or less, S: 0.020% or less, Al: 0.005% or more and 0.10% or less, N: 0.010% or less, Nb: 0.15% or less, V: 0.15% or less, Ti: 0.15% or less, and one or more selected from Cr: 1.0% or less, Mo: 1.0% or less, Cu: 1.0% or less, Ni: 1.0% or less, Ca: 0.010% or less, and B: 0.010% or less, with the balance being Fe and incidental impurities.

[3] A method for producing the high-strength hot rolled steel sheet according to [1] or [2], the method including a hot rolling step of hot rolling a steel material having the chemical composition, first and second cooling steps subsequent to the hot rolling step, and a step of performing coiling subsequent to the cooling steps, wherein:

in the hot rolling step, after a temperature has been increased to a heating temperature of 1100° C. or more and 1300° C. or less, hot rolling is performed such that a rough rolling delivery temperature is 900° C. or more and 1100° C. or less, a finish rolling start temperature is 800° C. or more and 950° C. or less, a finish rolling delivery temperature is 750° C. or more and 850° C. or less, and a total rolling reduction ratio during finish rolling is 60% or more;

in the first cooling step, cooling is performed such that an average cooling rate at a thickness center of the steel sheet in a thickness direction of the steel sheet is 10° C./s or more and 60° C./s or less and a cooling stop temperature at the thickness center is 550° C. or more and 650° C. or less, and such that a cooling stop temperature at a surface of the steel sheet is 250° C. or more and 450° C. or less;

a time interval between an end of the first cooling step and a start of the second cooling step is 5 s or more and 20 s or less; and in the second cooling step, cooling is performed such that an average cooling rate at the thickness center is cooled is 5° C./s or more and 30° C./s or less and a cooling stop temperature at the thickness center is 450° C. or more and 600° C. or less, and such that a cooling stop temperature at the surface of the steel sheet is 150° C. or more and 350° C. or less.

[4] A high-strength electric resistance welded steel pipe including a base metal zone and an electric resistance welded zone, wherein:

in a steel microstructure of the base metal zone at the center of the base metal zone in a wall-thickness direction of the high-strength electric resistance welded steel pipe, a volume fraction of bainite is 50% or more, a total volume fraction of ferrite and bainite is 95% or more, with the balance being one or more selected from pearlite, martensite, and austenite, an average grain size is 9.0 μm or less, and a dislocation density is $2.0\times10^{14}$ $m^{-2}$ or more and $1.0\times10^{15}$ $m^{-2}$ or less;

in a steel microstructure of the base metal zone at a position 0.1 mm below an inner surface of the high-strength electric resistance welded steel pipe in a depth direction of the steel pipe, a volume fraction of bainite is 70% or more, a total volume fraction of ferrite and bainite is 95% or more, with the balance being one or more selected from pearlite, martensite, and austenite, an average grain size is 9.0 μm or less, a dislocation density is $6.0\times10^{14}$ $m^{-2}$ or more and $1.0\times10^{15}$ $m^{-2}$ or less, and a maximum low angle grain boundary density is $1.5\times10^{6}$ $m^{-1}$ or less; and a wall thickness of the base metal zone is 15 mm or more.

[5] The high-strength electric resistance welded steel pipe according to [4], wherein the base metal zone has a chemical composition containing, by mass, C: 0.020% or more and 0.15% or less, Si: 1.0% or less, Mn: 0.30% or more and 2.0% or less, P: 0.050% or less, S: 0.020% or less, Al: 0.005% or more and 0.10% or less, N: 0.010% or less, Nb: 0.15% or less, V: 0.15% or less, Ti: 0.15% or less, and one or more selected from Cr: 1.0% or less, Mo: 1.0% or less, Cu: 1.0% or less, Ni: 1.0% or less, Ca: 0.010% or less, and B: 0.010% or less, with the balance being Fe and incidental impurities.

[6] A method for producing a high-strength electric resistance welded steel pipe, the method including forming the high-strength hot rolled steel sheet according to [1] or [2] into a cylindrical body by cold roll forming, butting edges of the cylindrical body in a circumferential direction of the cylindrical body to each other, and joining the edges to each other by electric resistance welding, wherein:

an amount of upset in the electric resistance welding is 20% or more and 100% or less of the thickness of the high-strength hot rolled steel sheet, and in a sizing step conducted subsequent to the electric resistance welding, diameter reduction is performed such that a perimeter of the steel pipe reduces at a rate of 0.5% or more and 4.0% or less.

According to aspects of the present invention, a high-strength electric resistance welded steel pipe having excellent SSC resistance even in the case where the steel pipe is a thick-walled steel material having a thickness of 15 mm or more, a high-strength hot rolled steel sheet used as a material for the high-strength electric resistance welded steel pipe, and methods for producing the high-strength electric resistance welded steel pipe and the high-strength hot rolled steel sheet can be provided.

BRIEF DESCRIPTION OF THE DRAWINGS

The FIGURE is a schematic diagram illustrating a cross section of a portion of an electric resistance welded steel pipe which includes a weld, the cross section being taken in the circumferential direction of the pipe (i.e., the cross section being perpendicular to the axial direction of the pipe).

DETAILED DESCRIPTION OF EMBODIMENTS OF THE INVENTION

A high-strength hot rolled steel sheet according to aspects of the present invention, a high-strength electric resistance welded steel pipe according to aspects of the present invention, and methods for producing the high-strength hot rolled steel sheet and the high-strength electric resistance welded steel pipe are described below. The present invention is not limited to the embodiment described below. In the high-strength electric resistance welded steel pipe according to aspects of the present invention, the chemical composition and steel microstructure of a base metal zone that is present at a position 90° from an electric resistance welded zone in the circumferential direction of the pipe with the position of the electric resistance welded zone in a cross section taken in the circumferential direction being 0° are specified. Although chemical composition and steel microstructure are specified at a position 90° from the electric resistance welded zone in this embodiment, chemical composition and steel microstructure do not vary at, for example, a position 180° from the electric resistance welded zone.

The reasons for the limitations on the steel microstructures of the high-strength hot rolled steel sheet and high-strength electric resistance welded steel pipe according to aspects of the present invention are described below.

In the steel microstructure of the high-strength hot rolled steel sheet according to aspects of the present invention at the center of the steel sheet in the thickness direction and the steel microstructure of a base metal zone of the high-strength electric resistance welded steel pipe according to aspects of the present invention at the center of the steel pipe in the wall-thickness direction, the volume fraction of bainite is 50% or more, and the total volume fraction of ferrite and bainite is 95% or more, with the balance including one or more selected from pearlite, martensite, and austenite.

In the steel microstructure of the high-strength hot rolled steel sheet according to aspects of the present invention at a position 0.1 mm below the surface of the steel sheet in the depth direction and the steel microstructure of the base metal zone of the high-strength electric resistance welded steel pipe according to aspects of the present invention at a position 0.1 mm below the inner surface of the pipe (or, the surface of the inside of the pipe) in the depth direction, the volume fraction of bainite is 70% or more, and the total volume fraction of ferrite and bainite is 95% or more, with the balance including one or more selected from pearlite, martensite, and austenite.

In the following description, the high-strength hot rolled steel sheet and the high-strength electric resistance welded steel pipe may be referred to simply as "hot rolled steel sheet" and "electric resistance welded steel pipe", respectively.

Ferrite is a soft microstructure. Bainite is a microstructure harder than ferrite and softer than pearlite, martensite, or austenite.

[Volume Fraction of Bainite]

If the volume fractions of bainite at the thickness center of the hot rolled steel sheet and the wall thickness center of the electric resistance welded steel pipe are less than 50% or the volume fraction of bainite at a position 0.1 mm (hereinafter, referred to as "0.1-mm depth position") below the surface of the hot rolled steel sheet in the depth direction and the volume fraction of bainite at a 0.1-mm depth position below the inner surface of the electric resistance welded steel pipe are less than 70%, the area fraction of soft ferrite is increased and, as a result, the yield strength intended in accordance with aspects of the present invention cannot be achieved. Thus, the volume fractions of bainite at the thickness center of the hot rolled steel sheet and the wall thickness center of the electric resistance welded steel pipe relative to the entire steel microstructure of the respective positions are limited to 50% or more. The volume fractions of bainite at the thickness center of the hot rolled steel sheet and the wall thickness center of the electric resistance welded steel pipe are preferably 60% or more and are further preferably 70% or more. The volume fractions of bainite at the 0.1-mm depth position below the surface of the hot rolled steel sheet and the 0.1-mm depth position below the inner surface of the electric resistance welded steel pipe relative to the entire steel microstructure of the respective positions are limited to 70% or more. The volume fractions of bainite at the 0.1-mm depth position below the surface of the hot rolled steel sheet and the 0.1-mm depth position below the inner surface of the electric resistance welded steel pipe are preferably 75% or more and are further preferably 80% or more.

The upper limits for the volume fractions of bainite at the thickness center of the hot rolled steel sheet, the wall thickness center of the electric resistance welded steel pipe, the 0.1-mm depth position below the surface of the hot rolled steel sheet, and the 0.1-mm depth position below the inner surface of the electric resistance welded steel pipe are not limited. In consideration of ductility, the volume fractions of bainite at the thickness center of the hot rolled steel sheet and the wall thickness center of the electric resistance welded steel pipe are preferably 95% or less. In consideration of SSC resistance, the volume fractions of bainite at the 0.1-mm depth position below the surface of the hot rolled steel sheet and the 0.1-mm depth position below the inner surface of the electric resistance welded steel pipe are preferably maximized. The volume fractions of bainite at the 0.1-mm depth positions are preferably 99% or less in consideration of ductility.

[Total Volume Fraction of Ferrite and Bainite]

Mixing a hard microstructure with ferrite and bainite may enhance ductility advantageously. On the other hand, due to stress concentration caused as a result of difference in hardness, the interfaces are likely to act as an origin of SSC and SSC resistance becomes degraded consequently. This also results in the degradation of toughness. Therefore, the total volume fractions of ferrite and bainite at the thickness center of the hot rolled steel sheet, the wall thickness center of the electric resistance welded steel pipe, the 0.1-mm depth position below the surface of the hot rolled steel sheet, and the 0.1-mm depth position below the inner surface of the electric resistance welded steel pipe relative to the entire steel microstructure of the respective positions are limited to 95% or more. The total volume fractions of ferrite and bainite are preferably 97% or more and are more preferably 98% or more.

The upper limits for the total volume fractions of ferrite and bainite at the thickness center of the hot rolled steel sheet, the wall thickness center of the electric resistance welded steel pipe, the 0.1-mm depth position below the surface of the hot rolled steel sheet, and the 0.1-mm depth position below the inner surface of the electric resistance welded steel pipe are not limited. In consideration of ductility, the total volume fractions of ferrite and bainite at the thickness center of the hot rolled steel sheet and the wall thickness center of the electric resistance welded steel pipe are preferably 99% or less. In consideration of SSC resistance, the total volume fractions of ferrite and bainite at the 0.1-mm depth position below the surface of the hot rolled steel sheet and the 0.1-mm depth position below the inner surface of the electric resistance welded steel pipe are preferably maximized. The total volume fractions of ferrite and bainite at the 0.1-mm depth positions are preferably 99% or less in consideration of ductility.

In accordance with aspects of the present invention, the volume fractions of ferrite at the thickness center of the hot rolled steel sheet, the wall thickness center of the electric resistance welded steel pipe, the 0.1-mm depth position below the surface of the hot rolled steel sheet, and the 0.1-mm depth position below the inner surface of the electric resistance welded steel pipe relative to the entire steel microstructure of the respective positions are preferably 3% or more. The volume fractions of ferrite at the thickness center of the hot rolled steel sheet and the wall thickness center of the electric resistance welded steel pipe are preferably 50% or less. The volume fractions of ferrite at the 0.1-mm depth position below the surface of the hot rolled steel sheet and the 0.1-mm depth position below the inner surface of the electric resistance welded steel pipe are preferably 30% or less. In such a case, the effects of enhancing ductility and SSC resistance can be produced in a further effective manner.

[Balance: One or More Selected From Pearlite, Martensite, and Austenite]

At the thickness center of the hot rolled steel sheet, the wall thickness center of the electric resistance welded steel pipe, the 0.1-mm depth position below the surface of the hot rolled steel sheet, and the 0.1-mm depth position below the inner surface of the electric resistance welded steel pipe, the balance includes one or more selected from pearlite, martensite, and austenite. If the total volume fraction of the above microstructures is more than 5%, the volume fraction of hard microstructures is increased, dislocation density and/or maximum low angle grain boundary density is increased, and SSC resistance becomes degraded accordingly. Therefore, the above total volume fractions of the above microstructures relative to the entire steel microstructure of the respective positions are limited to 5% or less and are more preferably 3% or less.

The nucleation sites of the above microstructures other than austenite are austenite grain boundaries or deformation bands included in austenite grains. Increasing the amount of rolling reduction performed at low temperatures, at which recrystallization of austenite is less likely to occur, during hot rolling introduces a number of dislocations to austenite to refine austenite and further introduces a number of deformation bands to the grains. This increases the area of nucleation sites and nucleation frequency and consequently refines the steel microstructure.

In accordance with aspects of the present invention, the above-described advantageous effects can be produced even when the above steel microstructure is present in regions that extend ±1.0 mm from the thickness center of the hot rolled steel sheet or the wall thickness center of the electric resistance welded steel pipe in the thickness direction (depth direction) or wall-thickness direction (depth direction). Therefore, the expression "steel microstructure at the thickness (or wall-thickness) center" used in accordance with aspects of the present invention means that the above steel microstructure is present in either of the regions that extend ±1.0 mm from the thickness (or wall-thickness) center in the thickness (or wall-thickness) direction. The above-described advantageous effects can be produced even when the above steel microstructure is present in regions that extend ±0.06 mm from the 0.1-mm depth position below the surface of the hot rolled steel sheet or the 0.1-mm depth position below the inner surface of the electric resistance welded steel pipe in the thickness (or wall-thickness) direction. Therefore, the expression "steel microstructure at the 0.1-mm depth position below the surface of the sheet (or the inner surface of the pipe)" used in accordance with aspects of the present invention means that the above steel microstructure is present in either of the regions that extend ±0.06 mm from the 0.1-mm depth position below the surface of the sheet (or the inner surface of the pipe) in the thickness (or wall-thickness) direction.

The steel microstructure can be observed by the method described in Examples below.

A test specimen for microstructure observation is taken such that the observation plane is a cross section parallel to both rolling and thickness directions of the hot rolled steel sheet and is the center of the steel sheet in the thickness direction or such that the observation plane is a cross section parallel to both pipe-axis and wall-thickness directions of the electric resistance welded steel pipe and is the center of the pipe in the wall-thickness direction. The test specimen is polished and subsequently etched with nital. In the microstructure observation, the microstructure of the thickness (or wall-thickness) center is observed and images thereof are taken with an optical microscope (magnification: 1000×) or a scanning electron microscope (SEM, magnification: 1000×). On the basis of the optical microscope images and the SEM images, the area fractions of bainite and the balance (i.e., ferrite, pearlite, martensite, and austenite) are determined. In the measurement of the area fraction of each microstructure, observation is made in five or more fields of view, and the average of the values obtained in the fields of view is calculated. Note that, in accordance with aspects of the present invention, the area fraction determined by the observation of a microstructure is defined as the volume fraction of the microstructure.

Ferrite is a product of diffusion transformation and appears as a substantially recovered microstructure having a low dislocation density. Examples of ferrite include polygonal ferrite and quasi-polygonal ferrite.

Bainite is a multi-phase microstructure consisting of lath ferrite, which has a high dislocation density, and cementite.

Pearlite is a eutectoid microstructure consisting of iron and iron carbide (ferrite+cementite) and appears as a lamellar microstructure composed of alternating layers of ferrite and cementite.

Martensite is a lath low-temperature transformation microstructure having a markedly high dislocation density. In SEM images, martensite appears bright relative to ferrite or bainite.

In optical microscope images and SEM images, it is difficult to distinguish martensite and austenite from each other. Therefore, the volume fraction of martensite is determined by measuring the area fraction of a microstructure identified as martensite or austenite in a SEM image and subtracting the volume fraction of austenite which is measured by the method described below from the above measured value.

Austenite is an fcc phase. The volume fraction of austenite is determined by X-ray diffraction using a test specimen prepared as in the preparation of the test specimen used in the measurement of dislocation density. The volume fraction of austenite is calculated on the basis of the integral intensities of the (200), (220), and (311)-planes of fcc iron and the (200) and (211)-planes of bcc iron.

In the steel microstructure of the hot rolled steel sheet at the thickness center, the average grain size is 9.0 μm or less, and the dislocation density is $1.0\times10^{14}$ $m^{-2}$ or more and $1.0\times10^{15}$ $m^{-2}$ or less. In the steel microstructure of the hot rolled steel sheet at the 0.1-mm depth position below the surface of the sheet, the average grain size is 9.0 μm or less, the dislocation density is $5.0\times10^{14}$ $m^{-2}$ or more and $1.0\times10^{15}$ $m^{-2}$ or less, and the maximum low angle grain boundary density is $1.4\times10^{6}$ $m^{-1}$ or less.

In the steel microstructure of the electric resistance welded steel pipe at the wall thickness center, the average grain size is 9.0 μm or less, and the dislocation density is $2.0\times10^{14}$ $m^{-2}$ or more and $1.0\times10^{15}$ $m^{-2}$ or less. In the steel microstructure of the electric resistance welded steel pipe at the 0.1-mm depth position below the inner surface of the pipe, the average grain size is 9.0 μm or less, the dislocation density is $6.0\times10^{14}$ $m^{-2}$ or more and $1.0\times10^{15}$ $m^{-2}$ or less, and the maximum low angle grain boundary density is $1.5\times10^{6}$ $m^{-1}$ or less.

In accordance with aspects of the present invention, the term "average grain size" refers to the average of equivalent circular diameters of crystal grains that are the regions surrounded by boundaries each drawn such that the misorientations between crystals adjacent to each other across the boundary is 15° or more. The term "equivalent circular diameter (grain size)" refers to the diameter of a circle having the same area as the target crystal grain.

In accordance with aspects of the present invention, the term "low angle grain boundary density" refers to the total length of grain boundaries between crystal grains having a misorientation of 2° or more and less than 15° per unit area of a cross section. The term "maximum low angle grain boundary density" refers to a possible maximum low angle grain boundary density measured in a 10 μm×10 μm field of view.

In a portion having a high dislocation density, the dislocations are aligned with one another to form a stable structure, and low-angle grain boundaries are formed consequently. However, even when the dislocations form a stable structure, a stress field created by the dislocations still remains. Therefore, a portion in which a number of low angle grain boundaries are present, that is, a portion, in which the low angle grain boundary density is high, locally has a high stress and is likely to act as an origin of SSC. Since the local high-stress portion is, for example, an interface between a hard phase or inclusion and a soft phase adjacent thereto and is a microscopic region, it is difficult to determine such a portion by using a common Vickers hardness test or measuring dislocation density by X-ray diffraction. It is possible to determine the local high-stress portion by measuring the maximum low angle grain boundary density using the SEM/EBSD method described below.

[Average Grain Size]

If the average grain size at the thickness center of the hot rolled steel sheet, the 0.1-mm depth position below the surface of the sheet, the wall thickness center of the electric resistance welded steel pipe, or the 0.1-mm depth position below the inner surface of the pipe is more than 9.0 μm, the steel microstructure is not refined to a sufficient degree and, consequently, the yield strength intended in accordance with aspects of the present invention cannot be achieved. Furthermore, toughness becomes degraded.

Accordingly, the average grain sizes at the thickness center of the hot rolled steel sheet, the 0.1-mm depth position below the surface of the sheet, the wall thickness center of the electric resistance welded steel pipe, and the 0.1-mm depth position below the inner surface of the pipe are limited to 9.0 μm or less. The above average grain sizes are preferably 7.0 μm or less and are more preferably 6.5 μm or less. If the above average grain sizes are reduced, dislocation density is increased and SSC resistance becomes degraded. Therefore, the above average grain sizes are preferably 3.0 μm or more and are more preferably 4.0 μm or more.

[Dislocation Density]

If the dislocation density at the thickness center of the hot rolled steel sheet is less than $1.0\times10^{14}$ $m^{-2}$, or the dislocation density at the wall thickness center of the electric resistance welded steel pipe is less than $2.0\times10^{14}$ $m^{-2}$, dislocation hardening does not occur to a sufficient degree and, consequently, the yield strength intended in accordance with aspects of the present invention cannot be achieved. Therefore, the dislocation density at the thickness center of the hot rolled steel sheet is limited to $1.0\times10^{14}$ $m^{-2}$ or more. The dislocation density at the thickness center of the hot rolled steel sheet is preferably $2.0\times10^{14}$ $m^{-2}$ or more and is more preferably $3.0\times10^{14}$ $m^{-2}$ or more. The dislocation density at the wall thickness center of the electric resistance welded steel pipe is limited to $2.0\times10^{14}$ $m^{-2}$ or more. The dislocation density at the wall thickness center of the electric resistance welded steel pipe is preferably $2.5\times10^{14}$ $m^{-2}$ or more and is more preferably $4.0\times10^{14}$ $m^{-2}$ or more.

If the dislocation density at the thickness center of the hot rolled steel sheet or the wall thickness center of the electric resistance welded steel pipe is more than $1.0\times10^{15}$ $m^{-2}$, the dislocation density and maximum low angle grain boundary density in the surface of the sheet or the inner surface of the pipe are increased and, consequently, SSC resistance becomes degraded. Moreover, toughness becomes degraded. Accordingly, the dislocation densities at the thickness center of the hot rolled steel sheet and the wall thickness center of the electric resistance welded steel pipe are limited to $1.0\times10^{15}$ $m^{-2}$ or less. The dislocation densities at the thickness center of the hot rolled steel sheet and the wall thickness center of the electric resistance welded steel pipe are preferably $9.6\times10^{14}$ $m^{-2}$ or less, are more preferably $9.0\times10^{14}$ $m^{-2}$ or less, and are further preferably $8.5\times10^{14}$ $m^{-2}$ or more.

If the dislocation density at the 0.1-mm depth position below the surface of the hot rolled steel sheet is less than $5.0\times10^{14}$ $m^{-2}$ or the dislocation density at the 0.1-mm depth position below the inner surface of the electric resistance welded steel pipe is less than $6.0\times10^{14}$ $m^{-2}$, dislocation hardening does not occur to a sufficient degree and, consequently, the yield strength intended in accordance with aspects of the present invention cannot be achieved. Accordingly, the dislocation density at the 0.1-mm depth position below the surface of the hot rolled steel sheet is limited to $5.0\times10^{14}$ $m^{-2}$ or more. The dislocation density at the 0.1-mm depth position below the surface of the hot rolled steel sheet is preferably $5.5\times10^{14}$ $m^{-2}$ or more. The dislocation density at the 0.1-mm depth position below the inner surface of the electric resistance welded steel pipe is limited to $6.0\times10^{14}$ $m^{-2}$ or more. The dislocation density at the 0.1-mm depth position below the inner surface of the electric resistance welded steel pipe is preferably $6.5\times10^{14}$ $m^{-2}$ or more.

If the dislocation density at the 0.1-mm depth position below the surface of the hot rolled steel sheet or the 0.1-mm depth position below the inner surface of the electric resistance welded steel pipe is more than $1.0\times10^{15}$ $m^{-2}$, the maximum low angle grain boundary density in the surface of the sheet or the inner surface of the pipe is increased and, consequently, SSC resistance becomes degraded. Moreover, toughness becomes degraded. Accordingly, the dislocation densities at the 0.1-mm depth position below the surface of the hot rolled steel sheet and the 0.1-mm depth position below the inner surface of the electric resistance welded steel pipe are limited to $1.0\times10^{15}$ $m^{-2}$ or less. The dislocation densities at the 0.1-mm depth position below the surface of the hot rolled steel sheet and the 0.1-mm depth position below the inner surface of the electric resistance welded steel pipe are preferably $9.0\times10^{14}$ $m^{-2}$ or less and are more preferably $8.8\times10^{14}$ $m^{-2}$ or less.

[Maximum Low Angle Grain Boundary Density]

If the maximum low angle grain boundary density in the 0.1-mm depth position below the surface of the hot rolled steel sheet is more than $1.4\times10^{6}$ $m^{-1}$ or the maximum low angle grain boundary density in the 0.1-mm depth position below the inner surface of the electric resistance welded steel pipe is more than $1.5\times10^{6}$ $m^{-1}$, a high local stress is generated at the surface of the sheet or the inner surface of the pipe and, consequently, SSC resistance becomes degraded. Accordingly, the maximum low angle grain boundary density in the 0.1-mm depth position below the surface of the hot rolled steel sheet is limited to $1.4\times10^{6}$ $m^{-1}$ or less. The maximum low angle grain boundary density in the 0.1-mm depth position below the surface of the hot rolled steel sheet is preferably $1.3\times10^{6}$ $m^{-1}$ or less. The maximum low angle grain boundary density in the 0.1-mm depth position below the inner surface of the electric resistance welded steel pipe is limited to $1.5\times10^{6}$ $m^{-1}$ or less. The maximum low angle grain boundary density in the 0.1-mm depth position below the inner surface of the electric resistance welded steel pipe is preferably $1.4\times10^{6}$ $m^{-1}$ or less.

The lower limit for the above maximum low angle grain boundary density is not specified. The presence of pearlite, martensite, or austenite increases the maximum low angle grain boundary density. Since it is difficult to set the total volume fraction of the above phases to 0%, the maximum low angle grain boundary density in the 0.1-mm depth position below the surface of the hot rolled steel sheet is preferably $0.080\times10^{6}$ $m^{-1}$ or more. The maximum low angle grain boundary density in the 0.1-mm depth position below the inner surface of the electric resistance welded steel pipe is preferably $0.10\times10^{6}$ $m^{-1}$ or more.

As detailed in Examples below, the average grain size, dislocation density, and maximum low angle grain boundary density in the steel microstructure can be measured by the following methods.

The average grain size is measured in the following manner. A cross section of the hot rolled steel sheet which is parallel to both rolling and thickness directions or a cross section of the electric resistance welded steel pipe which is parallel to both axial and wall-thickness directions is mirror-polished. Histograms (graph with the horizontal axis representing grain size and the vertical axis representing abundance at each grain size) of grain size distributions at the thickness center of the hot rolled steel sheet and the 0.1-mm depth position below the surface of the sheet, or the wall thickness center of the electric resistance welded steel pipe and the 0.1-mm depth position below the inner surface of the pipe are calculated by SEM/EBSD. The arithmetic averages of grain sizes are calculated. The measurement conditions are as follows: acceleration voltage: 15 kV, measurement region: 100 μm×100 μm, and measurement step size (measurement resolution): 0.5 μm. The average of values measured in five or more fields of view is calculated. In the analysis of grain size, grains having a size of less than 2.0 μm are considered as measurement noises and excluded from the analysis targets.

The dislocation densities in the thickness center of the hot rolled steel sheet and the wall thickness center of the electric resistance welded steel pipe are determined in the following manner. A cross section of the hot rolled steel sheet which is parallel to both rolling and thickness directions or a cross section of the electric resistance welded steel pipe which is parallel to the axial and wall-thickness directions is mirror-polished. The polished surface is electropolished 100 μm to remove a worked surface layer. A test specimen is prepared such that the diffraction plane is located at the thickness (or wall-thickness) center. X-ray diffraction is performed using the test specimen. The dislocation density can be determined on the basis of the results by the modified Williamson-Hall method and the modified Warren-Averbach method (Reference Literatures 1 and 2). The Burgers vector b can be $0.248\times10^{-9}$ m, which is the interatomic distance in <111> that is the slip direction of bcc iron.

[Reference Literature 1] T. Ungar and A. Borbely: Appl. Phys. Lett., 69 (1996), 3173.

[Reference Literature 2] M. Kumagai, M. Imafuku, S. Ohya: ISIJ International, 54 (2014), 206.

The dislocation densities at the 0.1-mm depth position below the surface of the hot rolled steel sheet and the 0.1-mm depth position below the inner surface of the electric resistance welded steel pipe are determined in the following manner. The surface of the hot rolled steel sheet or the inner surface of the electric resistance welded steel pipe is mirror-polished. The polished surface is electropolished 50 μm in order to remove a worked surface layer. The dislocation density is measured by performing X-ray diffraction as in the measurement at the thickness (or wall thickness) center described above.

The maximum low angle grain boundary density is determined by mirror polishing a cross section of the hot rolled steel sheet which is parallel to both the rolling and thickness directions or a cross section of the electric resistance welded steel pipe which is parallel to both axial and wall-thickness directions and subsequently using the SEM/EBSD method. Specifically, the 0.1-mm depth position below the surface of the hot rolled steel sheet or the 0.1-mm depth position below the inner surface of the electric resistance welded steel pipe is observed in 20 or more fields of view with the measurement range being 10 μm×10 μm. For each of the fields of view, the total length of grain boundaries having a misorientation of 2° or more and less than 15° is calculated. The low angle grain boundary density is calculated in each of the fields of view. In accordance with aspects of the present invention, the maximum of the low angle grain boundary densities measured in the above measurement positions is used as a maximum low angle grain boundary density.

The preferable ranges of the chemical compositions of the high-strength electric resistance welded steel pipe according to aspects of the present invention and the high-strength hot rolled steel sheet used as a material for the high-strength electric resistance welded steel pipe in order to achieve the above-described properties, the steel microstructure, and the like and the reasons for the limitations on the compositions are described below. In the present description, the symbol "%" used for expressing the chemical composition of steel means "% by mass" unless otherwise specified.

C: 0.020% or More and 0.15% or Less

C is an element that increases steel strength by solid solution strengthening. For maintaining the strength intended in accordance with aspects of the present invention, the C content is preferably 0.020% or more. However, if the C content is more than 0.15%, hardenability is enhanced and, consequently, hard pearlite, martensite, and austenite phases are formed in excessive amounts. Accordingly, the C content is preferably 0.15% or less. The C content is more preferably 0.025% or more and 0.12% or less. The C content is further preferably 0.030% or more and 0.10% or less.

Si: 1.0% or Less

Si is an element that increases steel strength by solid solution strengthening. For producing the above advantageous effects, the Si content is desirably 0.02% or more. However, if the Si content is more than 1.0%, ductility and toughness become degraded. Accordingly, the Si content is preferably 1.0% or less. The Si content is more preferably 0.05% or more and 0.70% or less. The Si content is further preferably 0.10% or more and 0.50% or less.

Mn: 0.30% or More and 2.0% or Less

Mn is an element that increases steel strength by solid solution strengthening. Mn is also an element that contributes to microstructure refinement by lowering the transformation start temperature. For maintaining the strength and steel microstructure intended in accordance with aspects of the present invention, the Mn content is preferably 0.30% or more. However, if the Mn content is more than 2.0%, hardenability is enhanced and, consequently, hard pearlite, martensite, and austenite phases are formed in excessive amounts. Accordingly, the Mn content is preferably 2.0% or less. The Mn content is more preferably 0.40% or more and 1.9% or less. The Mn content is further preferably 0.50% or more and 1.8% or less.

P: 0.050% or Less

The P content is preferably minimized as an incidental impurity because P segregates at grain boundaries to cause material inhomogeneity. The P content is preferably 0.050% or less. The P content is more preferably 0.040% or less and is further preferably 0.030% or less. Although the lower limit for the P content is not specified, the P content is preferably 0.001% or more because an excessive reduction in the P content results in increases in the refining costs.

S: 0.020% or Less

S is normally present in steel in the form of MnS. In a hot rolling step, the MnS particles are stretched thin and adversely affect ductility and toughness. Accordingly, in accordance with aspects of the present invention, it is preferable to minimize the S content. The S content is preferably 0.020% or less. The S content is more preferably 0.010% or less and is further preferably 0.0050% or less. Although the lower limit for the S content is not specified, the S content is preferably 0.0001% or more because an excessive reduction in the S content results in increases in the refining costs.

Al: 0.005% or More and 0.10% or Less

Al is an element that serves as a strong deoxidizing agent. For producing the above advantageous effects, the Al content is preferably 0.005% or more. However, if the Al content is more than 0.10%, weldability becomes degraded. Furthermore, the amount of alumina-based inclusions is increased and, consequently, surface quality becomes degraded. Moreover, toughness becomes degraded. Accordingly, the Al content is preferably 0.005% or more and 0.10% or less. The Al content is more preferably 0.010% or more and 0.080% or less. The Al content is further preferably 0.015% or more and 0.070% or less.

N: 0.010% or Less

N is an element that is an incidental impurity and firmly fixes the dislocation movement to degrade ductility and toughness. In accordance with aspects of the present invention, the N content is desirably minimized as an impurity. The allowable maximum N content is 0.010%. Accordingly, the N content is limited to 0.010% or less. The N content is preferably 0.0080% or less. The N content is preferably 0.0010% or more because an excessive reduction in the N content results in increases in the refining costs.

Nb: 0.15% or Less

Nb forms fine carbide and nitride particles in steel to increase steel strength. Nb is also an element that reduces the likelihood of austenite being coarsened during hot rolling and thereby contributes to microstructure refinement. For producing the above advantageous effects, the Nb content is desirably 0.002% or more. However, if the Nb content is more than 0.15%, ductility and toughness become degraded. Accordingly, the Nb content is preferably 0.15% or less. The Nb content is more preferably 0.005% or more and 0.13% or less. The Nb content is further preferably 0.010% or more and 0.10% or less.

V: 0.15% or Less

V forms fine carbide and nitride particles in steel to increase steel strength. For producing the above advantageous effects, the V content is desirably 0.002% or more. However, if the V content is more than 0.15%, ductility and toughness become degraded. Accordingly, the V content is preferably 0.15% or less. The V content is more preferably 0.005% or more and 0.13% or less. The V content is further preferably 0.010% or more and 0.10% or less. The V content is still further preferably 0.090% or less.

Ti: 0.15% or Less

Ti forms fine carbide and nitride particles in steel to increase steel strength. Ti is also an element that contributes to a reduction in the solute N content in steel because Ti has a high affinity for N. For producing the above advantageous effects, the Ti content is desirably 0.002% or more. However, if the Ti content is more than 0.15%, ductility and toughness become degraded. Accordingly, the Ti content is preferably 0.15% or less. The Ti content is more preferably 0.005% or more and 0.13% or less. The Ti content is further preferably 0.010% or more and 0.10% or less. The Ti content is still further preferably 0.070% or less.

The chemical composition may further contain the following elements in addition to the above-described constituents. Since the following element constituents (Cr, Mo, Cu, Ni, Ca, and B) are optional, the contents of the above constituents may be 0%.

One or More Selected from Cr: 1.0% or Less, Mo: 1.0% or Less, Cu: 1.0% or Less, Ni: 1.0% or Less, Ca: 0.010% or Less, and B: 0.010% or Less Cu: 1.0% or Less, Ni: 1.0% or Less, Cr: 1.0% or Less, and Mo: 1.0% or Less Cu, Ni, Cr, and Mo are elements that enhance steel hardenability and increase steel strength. The chemical composition may optionally contain Cu, Ni, Cr, and Mo as needed. For producing the above advantageous effects, in the case where the chemical composition contains Cu, Ni, Cr, and Mo, the contents of Cu, Ni, Cr, and Mo are desirably Cu: 0.01% or more, Ni: 0.01% or more, Cr: 0.01% or more, and Mo: 0.01% or more. However, an excessively high Cu, Ni, Cr, or Mo content may result in excessive formation of hard pearlite, martensite, and austenite phases. Accordingly, in the case where the chemical composition contains Cu, Ni, Cr, and Mo, the contents of Cu, Ni, Cr, and Mo are preferably Cu: 1.0% or less, Ni: 1.0% or less, Cr: 1.0% or less, and Mo: 1.0% or less. Thus, in the case where the chemical composition contains Cu, Ni, Cr, and Mo, the contents of Cu, Ni, Cr, and Mo are preferably Cu: 0.01% or more and 1.0% or less, Ni: 0.01% or more and 1.0% or less, Cr: 0.01% or more and 1.0% or less, and Mo: 0.01% or more and 1.0% or less, are more preferably Cu: 0.05% or more and Cu: 0.70% or less, Ni: 0.05% or more and Ni: 0.70% or less, Cr: 0.05% or more and Cr: 0.70% or less, and Mo: 0.05% or more and Mo: 0.70% or less, and are further preferably Cu: 0.10% or more and Cu: 0.50% or less, Ni: 0.10% or more and Ni: 0.50% or less, Cr: 0.10% or more and Cr: 0.50% or less, and Mo: 0.10% or more and Mo: 0.50% or less.

Ca: 0.010% or Less

Ca is an element that spheroidizes sulfide particles, such as MnS particles, stretched thin in the hot rolling step and thereby contributes to improvement of steel toughness. The chemical composition may optionally contain Ca as needed. For producing the above advantageous effects, in the case where the chemical composition contains Ca, the Ca content is desirably 0.0005% or more. However, if the Ca content is more than 0.010%, Ca oxide clusters are formed in steel. This degrades toughness. Accordingly, in the case where the chemical composition contains Ca, the Ca content is preferably 0.010% or less. The Ca content is more preferably 0.0008% or more and 0.008% or less. The Ca content is further preferably 0.0010% or more and 0.0060% or less.

B: 0.010% or Less

B is an element that lowers the transformation start temperature and thereby contributes to microstructure refinement. The chemical composition may optionally contain B as needed. For producing the above advantageous effects, in the case where the chemical composition contains B, the B content is desirably 0.0003% or more. However, if the B content is more than 0.010%, ductility and toughness become degraded. Accordingly, in the case where the chemical composition contains B, the B content is preferably 0.010% or less. The B content is more preferably 0.0005% or more and 0.0030% or less. The B content is further preferably 0.0008% or more and 0.0020% or less.

The balance includes Fe and incidental impurities. Note that the chemical composition may contain O (oxygen): 0.0050% or less as an incidental impurity such that the advantageous effects according to aspects of the present invention are not impaired.

The above constituents are the fundamental chemical compositions of the high-strength hot rolled steel sheet and the base metal zone included in the high-strength electric resistance welded steel pipe according to aspects of the present invention. The properties intended in accordance with aspects of the present invention can be achieved with the fundamental chemical composition.

In accordance with aspects of the present invention, furthermore, the equivalent carbon content (Ceq) represented by Formula (1) is preferably 0.45% or less in order to reduce hardenability.

$$Ceq = C + Mn/6 + (Cr + Mo + V)/5 + (Cu + Ni)/15 \quad (1)$$

in Formula (1), C, Mn, Cr, Mo, V, Cu, and Ni represent the contents (% by mass) of the respective elements. The contents of absent elements are considered as zero.

If the equivalent carbon content is more than 0.45%, hardenability is increased and, consequently, hard pearlite, martensite, and austenite phases are formed in excessive amounts. The equivalent carbon content is preferably 0.45% or less, is more preferably 0.30% or less, and is further preferably 0.28% or less. The lower limit for the equivalent carbon content is not specified. For increasing the bainite fraction, the equivalent carbon content is desirably 0.20% or more. The equivalent carbon content is more preferably 0.22% or more.

Methods for producing the high-strength hot rolled steel sheet and the high-strength electric resistance welded steel pipe according to an embodiment of the present invention are described below.

The high-strength hot rolled steel sheet according to aspects of the present invention can be produced by, for example, heating a steel material having the above-described chemical composition to a heating temperature of 1100° C. or more and 1300° C. or less and hot rolling the steel material at a rough rolling delivery temperature of 900° C. or more and 1100° C. or less, a finish rolling start temperature of 800° C. or more and 950° C. or less, and a finish rolling delivery temperature of 750° C. or more and 850° C. or less, such that the total rolling reduction ratio during finish rolling is 60% or more (i.e., hot rolling step); in the subsequent first cooling step, performing cooling such that the average cooling rate at the center of the sheet in the thickness direction is 10° C./s or more and 60° C./s or less, the cooling stop temperature at the center of the sheet in the thickness direction is 550° C. or more and 650° C. or less, and the cooling stop temperature at the surface of the sheet is 250° C. or more and 450° C. or less, wherein the time interval between the end of the first cooling step and the start of the subsequent second cooling step is 5 s or more and 20 s or less; in the second cooling step, performing cooling such that the average cooling rate at the center of the sheet in the thickness direction is 5° C./s or more and 30° C./s or less, the cooling stop temperature at the center of the sheet in the thickness direction is 450° C. or more and 600° C. or less, and the cooling stop temperature at the surface of the sheet is 150° C. or more and 350° C. or less; and coiling the cooled steel sheet.

The high-strength electric resistance welded steel pipe according to aspects of the present invention can be produced by forming the high-strength hot rolled steel sheet into a cylindrical body by cold roll forming, butting both edges of the cylindrical body in the circumferential direction to each other, and joining the edges to each other by electric resistance welding.

In the description of the production method below, the symbol "° C." used for describing temperature refers to the temperature of the surface of a steel material or steel sheet (hot rolled steel sheet) unless otherwise specified. The above surface temperatures can be measured with a radiation thermometer or the like. The temperature of the center of the steel sheet in the thickness direction can be determined by calculating the temperature distribution inside a cross section of the steel sheet by heat-transfer analysis and correcting the results by using the surface temperature of the steel sheet. Note that the term "hot rolled steel sheet" refers to a hot rolled steel sheet and a hot rolled steel strip.

The method for producing the hot rolled steel sheet is described below.

In accordance with aspects of the present invention, the method for preparing a steel material (steel slab) is not limited. For example, all of the molten steel preparation methods using a converter, an electric arc furnace, a vacuum melting furnace, or the like are applicable. The casting method is not limited. For example, steel materials having intended dimensions can be produced by a casting method such as continuous casting. There is no harm in using an ingot casting-slabbing process instead of continuous casting. The molten steel may be further subjected to secondary refining, such as ladle refining.

The resulting steel material (steel slab) is heated to a heating temperature of 1100° C. or more and 1300° C. or less. The heated steel material is hot rolled to a hot rolled steel sheet (hot rolling step). The hot rolled steel sheet is subsequently cooled (i.e., first and second cooling steps). The cooled hot rolled steel sheet is coiled (coiling step). Hereby, a hot rolled steel sheet is prepared.

Heating Temperature: 1100° C. or More and 1300° C. or Less

If the heating temperature is less than 1100° C., the deformation resistance of the steel material that is to be rolled is increased, and it becomes difficult to roll the steel material. On the other hand, if the heating temperature is more than 1300° C., austenite grains become coarsened, it becomes impossible to form fine austenite grains in the subsequent rolling step (rough rolling and finish rolling), and it becomes difficult to achieve the average grain size intended in accordance with aspects of the present invention. Accordingly, the heating temperature in the hot rolling step is limited to 1100° C. or more and 1300° C. or less. The above heating temperature is more preferably 1120° C. or more and 1280° C. or less.

In accordance with aspects of the present invention, in addition to a conventional method in which, subsequent to the preparation of a steel slab (slab), the slab is temporarily cooled to room temperature and then reheated, energy-saving hot-charge rolling processes in which a hot slab is directly charged into a heating furnace without being cooled to room temperature or in which heat insulation is performed for a short period of time and rolling is then performed immediately may also be used with no problem.

Rough Rolling Delivery Temperature: 900° C. or More and 1100° C. or Less

If the rough rolling delivery temperature is less than 900° C., the temperature at the surface of the steel sheet is reduced to a temperature equal to or lower than the ferrite transformation start temperature during the subsequent finish rolling, a large amount of deformed ferrite is formed, and the dislocation density and the maximum low angle grain boundary density are increased consequently. As a result, it becomes difficult to achieve the dislocation density and maximum low angle grain boundary density intended in accordance with aspects of the present invention. If the rough rolling delivery temperature is more than 1100° C., the amount of rolling reduction performed within the austenite non-recrystallization temperature range becomes insufficient and, consequently, fine austenite grains cannot be formed. As a result, it becomes difficult to achieve the average grain size intended in accordance with aspects of the present invention and the yield strength is reduced. Accordingly, the rough rolling delivery temperature is limited to 900° C. or more and 1100° C. or less. The rough rolling delivery temperature is more preferably 920° C. or more and 1050° C. or less.

Finish Rolling Start Temperature: 800° C. or More and 950° C. or Less

If the finish rolling start temperature is less than 800° C., the temperature at the surface of the steel sheet is reduced to a temperature equal to or lower than the ferrite transformation start temperature during the finish rolling, a large amount of deformed ferrite is formed, and the dislocation density and the maximum low angle grain boundary density are increased consequently. As a result, it becomes difficult to achieve the dislocation density and maximum low angle grain boundary density intended in accordance with aspects of the present invention. If the finish rolling start temperature is more than 950° C., austenite grains become coarsened and a sufficient amount of deformation bands cannot be introduced to austenite. As a result, it becomes difficult to achieve the average grain size intended in accordance with aspects of the present invention and the yield strength is reduced. Accordingly, the finish rolling start temperature is limited to 800° C. or more and 950° C. or less. The finish rolling start temperature is more preferably 820° C. or more and 930° C. or less.

Finish Rolling Delivery Temperature: 750° C. or More and 850° C. or Less

If the finish rolling delivery temperature is less than 750° C., the temperature at the surface of the steel sheet is reduced to a temperature equal to or lower than the ferrite transformation start temperature during the finish rolling, a large amount of deformed ferrite is formed, and the dislocation density and/or the maximum low angle grain boundary density are increased consequently. As a result, it becomes difficult to achieve the dislocation density and maximum low angle grain boundary density intended in accordance with aspects of the present invention. If the finish rolling delivery temperature is more than 850° C., the amount of rolling reduction performed within the austenite non-recrystallization temperature range becomes insufficient and, consequently, fine austenite grains cannot be formed. As a result, it becomes difficult to achieve the average grain size intended in accordance with aspects of the present invention and the yield strength is reduced. Accordingly, the finish rolling delivery temperature is limited to 750° C. or more and 850° C. or less. The finish rolling delivery temperature is more preferably 770° C. or more and 830° C. or less.

Total Rolling Reduction Ratio in Finish Rolling: 60% or More

In accordance with aspects of the present invention, the sizes of subgrains included in austenite are reduced in the hot rolling step in order to refine the ferrite, bainite, and the balance microstructures formed in the subsequent cooling and coiling steps and to achieve a steel microstructure having the yield strength intended in accordance with aspects of the present invention. For reducing the sizes of subgrains included in austenite in the hot rolling step, it is necessary to increase the rolling reduction ratio within the austenite non-recrystallization temperature range and to introduce a sufficient amount of working strain. In order to achieve this, in accordance with aspects of the present invention, the total rolling reduction ratio in finish rolling is limited to 60% or more.

If the total rolling reduction ratio in finish rolling is less than 60%, a sufficient amount of working strain cannot be introduced in the hot rolling step and, consequently, a steel microstructure having the average grain size intended in accordance with aspects of the present invention cannot be formed. The total rolling reduction ratio in finish rolling is more preferably 65% or more. The upper limit for the total rolling reduction ratio is not specified. If the total rolling reduction ratio is more than 808, an increase in toughness relative to an increase in rolling reduction ratio is reduced and only the facility load is increased. Accordingly, the total rolling reduction ratio in finish rolling is preferably 80% or less. The total rolling reduction ratio is more preferably 75% or less.

The total rolling reduction ratio in finish rolling is the total of the ratios of rolling reductions performed in rolling passes included in the finish rolling.

In accordance with aspects of the present invention, the upper limit for the final thickness is not specified. In order to maintain the required rolling reduction ratio and in consideration of the control of the temperature of the steel sheet, the final thickness (i.e., the thickness of the steel sheet that has been subjected to finish rolling) is preferably 15 mm or more and 40 mm or less.

Subsequent to the hot rolling step, the hot rolled steel sheet is subjected to a two-stage cooling step.

As described above, in the cooling step, accelerated cooling is performed in two stages. The temperatures and cooling rates at the surface and inside of the steel sheet in the cooling steps and the time interval between the two cooling steps are adequately controlled. The above step is particularly important in accordance with aspects of the present invention because this reduces the likelihood of a portion in which the low angle grain boundary density is locally high being formed in the surface of the steel sheet.

In the first cooling step, the hot rolled steel sheet is cooled such that the average cooling rate at the center of the sheet in the thickness direction is 10° C./s or more and 60° C./s or less, the cooling stop temperature at the thickness center of the sheet is 550° C. or more and 650° C. or less, and the cooling stop temperature at the surface of the sheet is 250° C. or more and 450° C. or less.

Average Cooling Rate at Thickness Center in First Cooling Step: 10° C./s or More and 60° C./s or Less If the average cooling rate at which the temperature of the thickness center of the hot rolled steel sheet is reduced from the temperature at which the first cooling step is started to the cooling stop temperature of the first cooling step which is described below is less than 10° C./s, the ferrite fraction is increased and, consequently, a steel microstructure having the bainite fraction intended in accordance with aspects of the present invention cannot be formed. Furthermore, the frequency of nucleation of ferrite or bainite is reduced and ferrite or bainite becomes coarsened. As a result, a steel microstructure having the average grain size intended in accordance with aspects of the present invention cannot be formed. On the other hand, if the above average cooling rate at which the temperature of the thickness center of the hot rolled steel plate is reduced is more than 60° C./s, a large amount of martensite is formed in the surface of the steel sheet, the maximum low angle grain boundary density is increased, and, consequently, the SSC resistance becomes degraded. The average cooling rate at the thickness center of the sheet is preferably 15° C./s or more and is more preferably 18° C./s or more. The average cooling rate at the thickness center of the sheet is preferably 55° C./s or less and is more preferably 50° C./s or less.

In accordance with aspects of the present invention, in order to reduce the formation of ferrite in the surface of the steel sheet prior to the first cooling step, it is preferable to start the first cooling step immediately after the finish rolling has been finished.

Cooling Stop Temperature at Thickness Center of Sheet in First Cooling Step: 550° C. or More and 650° C. or Less If the cooling stop temperature to which the temperature of the thickness center of the hot rolled steel sheet is reduced is less than 550° C., the cooling stop temperature at the surface of the steel sheet becomes low, a large amount of martensite is formed in the surface of the steel sheet, the maximum low angle grain boundary density is increased, and consequently, the SSC resistance becomes degraded. If the cooling stop temperature to which the temperature of the thickness center of the hot rolled steel sheet is reduced is more than 650° C., the cooling stop temperature at the surface of the steel sheet becomes high, the ferrite fraction at the thickness center is increased, and consequently, a steel microstructure having the bainite fraction intended in accordance with aspects of the present invention cannot be formed. Furthermore, the frequency of nucleation of ferrite or bainite is reduced and ferrite or bainite becomes coarsened. As a result, a steel microstructure having the average grain size intended in accordance with aspects of the present invention cannot be formed. The cooling stop temperature at the thickness center of the sheet is preferably 560° C. or more and is more preferably 580° C. or more. The cooling stop temperature at the thickness center of the sheet is preferably 630° C. or less and is more preferably 620° C. or less.

Cooling Stop Temperature at Sheet Surface in First Cooling Step: 250° C. or More and 450° C. or Less If the cooling stop temperature to which the temperature of the surface of the hot rolled steel sheet is reduced is less than 250° C., a large amount of martensite is formed in the surface of the steel sheet, the maximum low angle grain boundary density is increased, and consequently, the SSC resistance becomes degraded. If the cooling stop temperature to which the temperature of the surface of the hot rolled steel sheet is reduced is more than 450° C., the cooling stop temperature at the thickness center becomes high, the ferrite fraction at the thickness center is increased, and consequently, a steel microstructure having the bainite fraction intended in accordance with aspects of the present invention cannot be formed. Furthermore, the frequency of nucleation of ferrite or bainite at the thickness center is reduced and ferrite or bainite becomes coarsened. As a result, a steel microstructure having the average grain size intended in accordance with aspects of the present invention cannot be formed. The cooling stop temperature at the surface of the sheet is preferably 280° C. or more and is more preferably 290° C. or more. The cooling stop temperature at the surface of the sheet is preferably 420° C. or less and is more preferably 410° C. or less.

In accordance with aspects of the present invention, the term "average cooling rate" refers to the value (cooling rate) calculated as ((Temperature of thickness center of hot rolled steel sheet before cooling−Temperature of thickness center of hot rolled steel sheet after cooling)/Amount of cooling time) unless otherwise specified. Examples of the cooling method include water cooling performed by, for example, injecting water from a nozzle, and cooling performed by injecting a coolant gas. In accordance with aspects of the present invention, it is preferable that both surfaces of the hot rolled steel sheet be subjected to a cooling operation (treatment) such that the both surfaces of the hot rolled steel sheet can be cooled under the same conditions.

After the first cooling step has been finished, the hot rolled steel sheet is allowed to be naturally cooled for 5 s or more and 20 s or less and subsequently subjected to a second cooling step. In the second cooling step, the hot rolled steel sheet is cooled such that the average cooling rate at the thickness center of the sheet is 5° C./s or more and 30° C./s or less, the cooling stop temperature at the thickness center of the sheet is 450° C. or more and 600° C. or less, and the cooling stop temperature at the surface of the sheet is 150° C. or more and 350° C. or less.

Time interval Between End of First Cooling Step and Start of Second Cooling Step: 5 s or More and 20 s or Less A time interval between the end of the first cooling step and the start of the second cooling step is set for allowing the steel sheet to be naturally cooled. This causes the ferrite or bainite phase formed in the first cooling step to be tempered and consequently reduces the dislocation density.

If the time interval between the end of the first cooling step and the start of the second cooling step is less than 5 s, ferrite or bainite cannot be tempered to a sufficient degree, the dislocation density in the surface of the sheet is increased, the maximum low angle grain boundary density is increased, and consequently SSC resistance becomes degraded. If the time interval between the end of the first cooling step and the start of the second cooling step is more than 20 s, the ferrite or bainite grains present at the thickness center become coarsened and the yield strength is reduced consequently. The time interval between the end of the first cooling step and the start of the second cooling step is preferably 10 s or more and 18 s or less.

For setting a time interval between the end of the first cooling step and the start of the second cooling step to allow the steel sheet to be naturally cooled, for example, in a facility that includes first and second cooling devices arranged sequentially, the line speed of the hot rolled steel sheet may be reduced. This enables the time required for allowing the steel sheet to be naturally cooled to be kept.

Average Cooling Rate at Thickness Center in Second Cooling Step: 5° C./s or More and 30° C./s or Less If the average cooling rate at which the temperature of the thickness center of the hot rolled steel sheet is reduced from the temperature at which the second cooling step is started to the cooling stop temperature of the second cooling step which is described below is less than 5° C./s, ferrite or bainite grains become coarsened and, consequently, a steel microstructure having the average grain size intended in accordance with aspects of the present invention cannot be formed. On the other hand, if the above average cooling rate at which the temperature of the thickness center of the hot rolled steel sheet is reduced is more than 30° C./s, a large amount of martensite is formed in the surface of the steel sheet, the maximum low angle grain boundary density is increased, and, consequently, the SSC resistance becomes degraded. The average cooling rate at the thickness center of the sheet is preferably 8° C./s or more and is more preferably 9° C./s or more. The average cooling rate at the thickness center of the sheet is preferably 25° C./s or less and is more preferably 15° C./s or less.

Cooling Stop Temperature at Thickness Center in Second Cooling Step: 450° C. or More and 600° C. or Less If the cooling stop temperature to which the temperature of the thickness center of the hot rolled steel sheet is reduced is less than 450° C., the cooling stop temperature at the surface of the steel sheet becomes low, a large amount of martensite is formed in the surface of the steel sheet, the maximum low angle grain boundary density is increased, and consequently, the SSC resistance becomes degraded. If the cooling stop temperature to which the temperature of the thickness center of the hot rolled steel sheet is reduced is more than 600° C., the cooling stop temperature at the surface of the steel sheet becomes high, ferrite or bainite grains become coarsened, and consequently, a steel microstructure having the average grain size intended in accordance with aspects of the present invention cannot be formed. The cooling stop temperature at the thickness center of the sheet is preferably 480° C. or more and is more preferably 490° C. or more. The cooling stop temperature at the thickness center of the sheet is preferably 570° C. or less and is more preferably 560° C. or less.

Cooling Stop Temperature at Sheet Surface in Second Cooling Step: 150° C. or More and 350° C. or Less If the cooling stop temperature to which the temperature of the surface of the hot rolled steel sheet is reduced is less than 150° C., a large amount of martensite is formed in the surface of the steel sheet, the maximum low angle grain boundary density is increased, and consequently, the SSC resistance becomes degraded. If the cooling stop temperature to which the temperature of the surface of the hot rolled steel sheet is reduced is more than 350° C., ferrite or bainite grains become coarsened at the thickness center and consequently, a steel microstructure having the average grain size intended in accordance with aspects of the present invention cannot be formed. The cooling stop temperature at the surface of the sheet is preferably 180° C. or more and is more preferably 200° C. or more. The cooling stop temperature at the surface of the sheet is preferably 320° C. or less and is more preferably 300° C. or less.

Subsequent to the second cooling step, a coiling step in which the hot rolled steel sheet is coiled and then allowed to be naturally cooled is conducted.

In the coiling step, coiling is preferably performed such that the temperature of the thickness center of the sheet, that is, the coiling temperature, is 400° C. or more and 600° C. or less in consideration of the microstructure of the steel sheet. If the coiling temperature is less than 400° C., a large amount of martensite is formed in the surface of the steel sheet, the maximum low angle grain boundary density is increased, and consequently, the SSC resistance becomes degraded. If the coiling temperature is more than 600° C., ferrite or bainite becomes coarsened and, consequently, a steel microstructure having the average grain size intended in accordance with aspects of the present invention cannot be formed. The coiling temperature is more preferably 430° C. or more and 580° C. or less.

A method for producing the electric resistance welded steel pipe is described below.

Subsequent to the coiling step, the hot rolled steel sheet is subjected to a pipe-making step. In the pipe-making step, the hot rolled steel sheet is formed into a cylindrical open pipe (round steel pipe) by cold roll forming, and electric resistance welding, in which both edges (butting portions) of the cylindrical open pipe in the circumferential direction are melted by high-frequency electric resistance heating and pressure-welded to each other by upset with squeeze rollers, is performed to form an electric resistance welded steel pipe. The electric resistance welded steel pipe produced in the above-described manner includes a base metal zone and an electric resistance weld. The electric resistance welded steel pipe is then subjected to a sizing step. In the sizing step, the diameter of the electric resistance welded steel pipe is reduced with rollers arranged to face the upper, lower, left, and right sides of the electric resistance welded steel pipe in order to adjust the outside diameter and roundness of the steel pipe to the intended values.

The amount of upset with which the electric resistance welding (i.e., electric resistance welding step) is performed is 20% or more of the thickness of the hot rolled steel sheet in order to enable the inclusions that degrade toughness, such as oxides and nitrides, to be discharged together with molten steel. However, if the amount of upset exceeds 100% of the thickness of the steel sheet, the load applied to the squeeze rollers is increased. In addition, the working strain of the electric resistance welded steel pipe is increased, the dislocation density in the inner surface of the pipe is increased, the maximum low angle grain boundary density is increased, and consequently the SSC resistance becomes degraded. Accordingly, the amount of upset is 20% or more and 100% or less of the thickness of the steel sheet and is preferably 40% or more and 80% or less of the thickness of the steel sheet.

The amount of upset can be calculated as ((Perimeter of open pipe immediately before electric resistance welding)−(Perimeter of electric resistance welded steel pipe immediately after electric resistance welding))/(Thickness)×100 (%).

The sizing step is performed subsequent to electric resistance welding in order to enhance the accuracy of outside diameter and roundness. In order to enhance the accuracy of outside diameter and roundness, the diameter of the steel pipe is reduced such that the perimeter of the steel pipe reduces by 0.5% or more in total. If the diameter reduction is performed such that the perimeter of the steel pipe reduces by more than 4.0% in total, when the steel pipe passes through the rollers, the amount the steel pipe is bent in the axial direction is increased and, accordingly, the residual stress is increased. This results in increases in the dislocation density in the inner surface of the pipe and the maximum low angle grain boundary density. As a result, the SSC resistance becomes degraded. Therefore, diameter reduction is performed such that the perimeter of the steel pipe reduces by 0.5% or more and 4.0% or less. The perimeter of the steel pipe is preferably 1.0% or more and 3.0% or less.

In the sizing step subsequent to the electric resistance welding, it is preferable to perform the diameter reduction in multiple stages with a plurality of stands in order to minimize the amount the steel pipe is bent in the axial direction while being passed through the rollers and limit the generation of the residual stress in the axial direction of the steel pipe. It is preferable that the reduction in the perimeter of the steel pipe which is achieved with each stand in the diameter reduction step be 1.0% or less.

Whether or not the steel pipe is an electric resistance welded steel pipe can be determined by cutting the electric resistance welded steel pipe in a direction perpendicular to the axial direction of the steel pipe, polishing a cross section of the steel pipe which includes a weld (electric resistance weld), etching the cross section, and then inspecting the cross section with an optical microscope. Specifically, the steel pipe is considered as an electric resistance welded steel pipe when the width of a molten and solidified zone of the weld (electric resistance weld) in the circumferential direction of the steel pipe is 1.0 μm or more and 1000 μm or less all over the entire thickness of the steel pipe.

The etchant used above may be selected appropriately in accordance with the constituents of the steel and the type of the steel pipe.

The FIGURE schematically illustrates a portion of the etched cross section (portion in the vicinity of the weld of the electric resistance welded steel pipe). The molten and solidified zone can be visually identified as a region (molten and solidified zone 3) having a microstructure and a contrast that are different from those of a base metal zone 1 or a heat affected zone 2, as illustrated in the FIGURE. For example, a molten and solidified zone of an electric resistance welded steel pipe composed of a carbon steel and a low-alloy steel can be identified as a region that appears white in the above nital-etched cross section when observed with an optical microscope, and a molten and solidified zone of a UOE steel line pipe composed of a carbon steel and a low-alloy steel can be identified as a region that includes a cell-like or dendrite solidified microstructure in the above nital-etched cross section when observed with an optical microscope.

The high-strength hot rolled steel sheet and the high-strength electric resistance welded steel pipe according to aspects of the present invention can be produced by the above-described production method. The high-strength hot rolled steel sheet according to aspects of the present invention has both excellent SSC resistance and a high yield strength even in the case where the high-strength hot rolled steel sheet has a large thickness of 15 mm or more. The high-strength electric resistance welded steel pipe according to aspects of the present invention has both excellent SSC resistance and a high yield strength even in the case where the base metal zone has a large wall thickness of 15 mm or more.

Examples

Details of the present invention are further described with reference to Examples below. Note that the present invention is not limited to Examples below.

Molten steels having the chemical compositions described in Table 1 were prepared and formed into slabs (steel materials). The slabs were subjected to a hot rolling step, first and second cooling steps, and a coiling step under the conditions described in Table 2. Hereby, hot rolled steel sheets having the final thicknesses (mm) described in Table 2 were prepared.

Subsequent to the coiling step, each of the hot rolled steel sheet was formed into a cylindrical open pipe (round steel pipe) by cold roll forming, and the butting edges of the open pipe were joined to each other by electric resistance welding. Hereby, a steel pipe material was prepared (i.e., pipe-making step). The diameter of the steel pipe material was reduced using the rollers arranged to face the upper, lower, left, and right sides of the steel pipe material (i.e., sizing step).

Hereby, electric resistance welded steel pipes having the outside diameters (mm) and wall thicknesses (mm) described in Table 4 were prepared.

Test specimens were taken from each of the hot rolled steel sheets and electric resistance welded steel pipes and subjected to the measurement of average grain size, the measurement of dislocation density, the measurement of maximum low angle grain boundary density, the microstructure observation, the tensile test, and the four-point bending corrosion test by the following methods. The test specimens of the hot rolled steel sheets were each taken at the center of the hot rolled steel sheets in the width direction. The test specimens of the electric resistance welded steel pipes were each taken from a portion of the base metal zone which was 90° away from the electric resistance welded zone in the circumferential direction of the pipe, with the position of the electric resistance welded zone being 0°.

[Measurement of Average Grain Size]

The test specimens for measurement were each taken from one of the hot rolled steel sheets or electric resistance welded steel pipes such that the measurement plane was a cross section of the hot rolled steel sheet which was parallel to both the rolling and thickness directions or a cross section of the electric resistance welded steel pipe which was parallel to both pipe axial and wall-thickness directions. The measurement planes were mirror-polished. The average grain size was measured using SEM/EBSD. In the measurement of grain size, the misorientations between the adjacent crystal grains were measured and the boundaries between crystal grains having a misorientation of 15° or more were considered as grain boundaries. The arithmetic average of the grain sizes (equivalent circular diameters) was calculated on the basis of the grain boundaries and used as an average grain size. The measurement was conducted under the following conditions: acceleration voltage: 15 kV, measurement region: 100 μm×100 μm, measurement step size: 0.5 μm.

In the grain size analysis, crystal grains having a size of less than 2.0 μm were considered as a measurement noise and excluded from analysis targets. The resulting area fraction was considered equal to the volume fraction. The measurement was conducted at the thickness center of the hot rolled steel sheet, the 0.1-mm depth position below the surface of the sheet, the wall thickness center of the electric resistance welded steel pipe, and the 0.1-mm depth position below the inner surface of the pipe. Histograms (graph with the horizontal axis representing grain size and the vertical axis representing abundance at each grain size) of grain size distributions were calculated at each of the above positions. The arithmetic averages of grain sizes were calculated as average grain sizes.

[Measurement of Dislocation Density]

The dislocation densities in the thickness center of the hot rolled steel sheet and the wall thickness center of the electric resistance welded steel pipe were determined in the following manner. Test specimens for dislocation density were each prepared by mirror-polishing a cross section of the hot rolled steel sheet which was parallel to both rolling and thickness directions or a cross section of the electric resistance welded steel pipe which was parallel to the axial and wall-thickness directions, and electropolishing the polished surface 100 μm to remove a worked surface layer, such that the diffraction plane was located at the thickness (or wall-thickness) center. The dislocation densities at the thickness center of the hot rolled steel sheets and the wall thickness center of the electric resistance welded steel pipes were determined by performing X-ray diffraction using the test specimens and analyzing the results by the modified Williamson-Hall method and the modified Warren-Averbach method (see Reference Literatures 1 and 2).

The dislocation densities at the 0.1-mm depth position below the surface of the hot rolled steel sheet and the 0.1-mm depth position below the inner surface of the electric resistance welded steel pipe were determined in the following manner. The test specimens for dislocation density were each taken such that the surface of the hot rolled steel sheet or the inner surface of the electric resistance welded steel pipe served as a measurement plane. The measurement plane was mirror polished and subsequently electropolished 50 μm in order to remove a worked surface layer. The test specimens were each prepared such that the diffraction plane was at the 0.1-mm depth position below the surface of the sheet or the inner surface of the pipe. The dislocation densities were determined by performing X-ray diffraction and analyzing the results as in the thickness (or wall thickness) center.

[Measurement of Maximum Low Angle Grain Boundary Density]

The test specimens for measurement were each taken from one of the hot rolled steel sheets and electric resistance welded steel pipes such that a cross section of the hot rolled steel sheet which was parallel to both rolling and thickness directions served as a measurement plane or a cross section of the electric resistance welded steel pipe which was parallel to both pipe axial and wall thickness directions served as a measurement plane. The measurement planes were mirror-polished. The maximum low angle grain boundary density was determined by SEM/EBSD.

Specifically, the 0.1-mm depth position below the surface of the hot rolled steel sheet or the 0.1-mm depth position below the inner surface of the electric resistance welded steel pipe was measured in 20 or more fields of view with the measurement range being 10 μm×10 μm. For each of the fields of view, the total length of grain boundaries having a misorientation of 2° or more and less than 15° was calculated. The low angle grain boundary density was calculated in each of the fields of view. In Examples, the maximum of the low angle grain boundary densities measured at the above measurement positions was used as a maximum low angle grain boundary density.

[Microstructure Observation]

Test specimens for microstructure observation were each taken from one of the hot rolled steel sheets and electric resistance welded steel pipes such that the observation plane was a cross section parallel to both rolling and thickness directions of the hot rolled steel sheet or such that the observation plane was a cross section parallel to both pipe-axis and wall-thickness directions of the electric resistance welded steel pipe. The test specimens were mirror-polished and subsequently etched with nital. In the microstructure observation, the microstructures of the thickness center of the hot rolled steel sheet and the 0.1-mm depth position below the surface of the hot rolled steel sheet or the microstructures of the wall thickness center of the electric resistance welded steel pipe and the 0.1-mm depth position below the inner surface of the pipe were observed and images thereof were taken with an optical microscope (magnification: 1000×) or a scanning electron microscope (SEM, magnification: 1000×). On the basis of the optical microscope images and the SEM images, the area fractions of bainite and the balance (i.e., ferrite, pearlite, martensite, and austenite) were determined. In the measurement of the area fraction of each microstructure, observation was made in five or more fields of view, and the average of the values obtained in the respective fields of view was calculated. In Examples, the area fraction determined by the observation of a microstructure was defined as the volume fraction of the microstructure.

Ferrite is a product of diffusion transformation and appears as a substantially recovered microstructure having a low dislocation density. Examples of ferrite include polygonal ferrite and quasi-polygonal ferrite.

Bainite is a multi-phase microstructure consisting of lath ferrite, which has a high dislocation density, and cementite.

Pearlite is a eutectoid microstructure consisting of iron and iron carbide (ferrite+cementite) and appears as a lamellar microstructure composed of alternating layers of ferrite and cementite.

Martensite is a lath low-temperature transformation microstructure having a markedly high dislocation density. In SEM images, martensite appears bright relative to ferrite or bainite.

In optical microscope images and SEM images, it is difficult to distinguish martensite and austenite from each other. Therefore, the volume fraction of martensite was determined by measuring the area fraction of the microstructure identified as martensite or austenite in a SEM image and subtracting the volume fraction of austenite which was measured by the method described below from the above measured value.

The volume fraction of austenite was determined using X-ray diffraction. Test specimens for the measurement of the thickness center of the hot rolled steel sheet and the wall thickness center of the electric resistance welded steel pipe were each prepared by performing grinding such that the diffraction plane was the thickness center of the hot rolled steel sheet or the wall thickness center of the electric resistance welded steel pipe and subsequently performing chemical polishing to remove a worked surface layer. Test specimens for the measurement of the 0.1-mm depth position below the surface of the hot rolled steel sheet and the 0.1-mm depth position below the inner surface of the electric resistance welded steel pipe were each prepared by performing mirror polishing such that the diffraction plane was the surface of the hot rolled steel sheet or the inner surface of the electric resistance welded steel pipe and chemically polishing the polished surface to remove a worked surface layer. In this measurement, Mo Kα radiation was used. The volume fraction of austenite was calculated on the basis of the integral intensities of the (200), (220), and (311)-planes of fcc iron and the (200) and (211)-planes of bcc iron.

[Tensile Test]

A JIS No. 5 test piece for tensile test was taken from each of the hot rolled steel sheets such that the tensile direction was parallel to the rolling direction. A JIS No. 5 test piece for tensile test was taken from each of the electric resistance welded steel pipes such that the tensile direction was parallel to the pipe-axial direction. The tensile test was conducted in conformity with JIS Z 2241. A yield strength (MPa) was measured. Note that the yield strength was a flow stress at a nominal strain of 0.5%.

[Four-Point Bending Corrosion Test]

A 5 mm thick×15 mm wide×115 mm long four-point bending corrosion test specimen was taken from each of the hot rolled steel sheets and the electric resistance welded steel pipes. The test specimen was taken from each of the hot rolled steel sheets such that the width direction of the corrosion test specimen was perpendicular to both rolling and thickness directions of the hot rolled steel sheet and the longitudinal direction of the corrosion test specimen was parallel to the rolling direction of the hot rolled steel sheet. The test specimen was taken from each of the electric resistance welded steel pipes such that the width direction of the corrosion test specimen was parallel to the circumferential direction of the electric resistance welded steel pipe and the longitudinal direction of the corrosion test specimen was parallel to the axial direction of the electric resistance welded steel pipe.

The test specimens were each taken such that the surface layer remained on the outer surface of the bend, that is, the etched surface. A four-point bending corrosion test was conducted in conformity with EFC16 while a tensile stress equal to 90% of the yield strength obtained in the above tensile test was applied onto the etched surface of the test specimen using a NACE Standard TM0177 Solution A at a partial pressure of hydrogen sulfide of 1 bar. After the test specimen had been immersed in the solution for 720 hours, whether cracking occurred was determined. Furthermore, a test specimen for observation was taken at the ⅓ and ⅔ positions of the test specimen used in the above test in the width direction such that the observation plane was a cross section parallel to the thickness and longitudinal directions. The test specimen for observation was mirror-polished and observed with an optical microscope to measure the depth and width of all the pitting corrosions formed at the portion on which the tensile stress was applied. The maximum depth of the pitting corrosions and the maximum (depth/width) of the pitting corrosions were calculated.

Tables 3 and 4 list the results.

TABLE 1

| | Chemical composition (mass %) | | | | | | | | | | | | | | | | |
|---|---|---|---|---|---|---|---|---|---|---|---|---|---|---|---|---|---|
| No. | C | Si | Mn | P | S | Al | N | Nb | V | Ti | Cr | Mo | Cu | Ni | Ca | B | Ceq |
| 1 | 0.049 | 0.21 | 1.22 | 0.004 | 0.0003 | 0.026 | 0.0033 | 0.043 | 0.044 | 0.012 | — | — | 0.15 | 0.12 | 0.0034 | — | 0.279 |
| 2 | 0.049 | 0.21 | 1.22 | 0.004 | 0.0003 | 0.026 | 0.0033 | 0.043 | 0.044 | 0.012 | — | — | 0.15 | 0.12 | 0.0034 | — | 0.279 |
| 3 | 0.049 | 0.21 | 1.22 | 0.004 | 0.0003 | 0.026 | 0.0033 | 0.043 | 0.044 | 0.012 | — | — | 0.15 | 0.12 | 0.0034 | — | 0.279 |
| 4 | 0.081 | 0.15 | 0.77 | 0.003 | 0.0006 | 0.041 | 0.0041 | 0.050 | 0.032 | 0.016 | 0.19 | 0.14 | — | — | 0.0022 | — | 0.282 |
| 5 | 0.081 | 0.15 | 0.77 | 0.003 | 0.0006 | 0.041 | 0.0041 | 0.050 | 0.032 | 0.016 | 0.19 | 0.14 | — | — | 0.0022 | — | 0.282 |
| 6 | 0.081 | 0.15 | 0.77 | 0.003 | 0.0006 | 0.041 | 0.0041 | 0.050 | 0.032 | 0.016 | 0.19 | 0.14 | — | — | 0.0022 | — | 0.282 |
| 7 | 0.026 | 0.43 | 1.61 | 0.025 | 0.0113 | 0.033 | 0.0028 | 0.054 | 0.009 | 0.034 | — | — | — | — | 0.0037 | 0.0005 | 0.296 |
| 8 | 0.026 | 0.43 | 1.61 | 0.025 | 0.0113 | 0.033 | 0.0028 | 0.054 | 0.009 | 0.034 | — | — | — | — | 0.0037 | 0.0005 | 0.296 |
| 9 | 0.026 | 0.43 | 1.61 | 0.025 | 0.0113 | 0.033 | 0.0028 | 0.054 | 0.009 | 0.034 | — | — | — | — | 0.0037 | 0.0005 | 0.296 |
| 10 | 0.026 | 0.43 | 1.61 | 0.025 | 0.0113 | 0.033 | 0.0028 | 0.054 | 0.009 | 0.034 | — | — | — | — | 0.0037 | 0.0005 | 0.296 |
| 11 | 0.112 | 0.04 | 0.84 | 0.008 | 0.0012 | 0.024 | 0.0037 | 0.061 | 0.023 | 0.021 | — | — | 0.12 | 0.11 | — | — | 0.272 |
| 12 | 0.112 | 0.04 | 0.84 | 0.008 | 0.0012 | 0.024 | 0.0037 | 0.061 | 0.023 | 0.021 | — | — | 0.12 | 0.11 | — | — | 0.272 |
| 13 | 0.112 | 0.04 | 0.84 | 0.008 | 0.0012 | 0.024 | 0.0037 | 0.061 | 0.023 | 0.021 | — | — | 0.12 | 0.11 | — | — | 0.272 |
| 14 | 0.054 | 0.33 | 1.29 | 0.011 | 0.0025 | 0.040 | 0.0022 | 0.037 | 0.045 | 0.009 | — | — | — | — | 0.0021 | — | 0.278 |
| 15 | 0.054 | 0.33 | 1.29 | 0.011 | 0.0025 | 0.040 | 0.0022 | 0.037 | 0.045 | 0.009 | — | — | — | — | 0.0021 | — | 0.278 |
| 16 | 0.054 | 0.33 | 1.29 | 0.011 | 0.0025 | 0.040 | 0.0022 | 0.037 | 0.045 | 0.009 | — | — | — | — | 0.0021 | — | 0.278 |

TABLE 1-continued

| No. | Chemical composition (mass %) | | | | | | | | | | | | | | | | |
|---|---|---|---|---|---|---|---|---|---|---|---|---|---|---|---|---|---|
| | C | Si | Mn | P | S | Al | N | Nb | V | Ti | Cr | Mo | Cu | Ni | Ca | B | Ceq |
| 17 | 0.054 | 0.33 | 1.29 | 0.011 | 0.0025 | 0.040 | 0.0022 | 0.037 | 0.045 | 0.009 | — | — | — | — | 0.0021 | — | 0.278 |
| 18 | 0.14 | 0.11 | 0.91 | 0.042 | 0.0095 | 0.034 | 0.0043 | 0.021 | 0.019 | 0.062 | — | — | — | — | 0.0016 | — | 0.295 |
| 19 | 0.14 | 0.11 | 0.91 | 0.042 | 0.0095 | 0.034 | 0.0043 | 0.021 | 0.019 | 0.062 | — | — | — | — | 0.0016 | — | 0.295 |
| 20 | 0.121 | 0.84 | 0.87 | 0.009 | 0.0081 | 0.022 | 0.0035 | 0.009 | 0.036 | 0.121 | — | — | — | — | 0.0017 | — | 0.273 |
| 21 | 0.121 | 0.84 | 0.87 | 0.009 | 0.0081 | 0.022 | 0.0035 | 0.009 | 0.036 | 0.121 | — | — | — | — | 0.0017 | — | 0.273 |
| 22 | 0.075 | 0.33 | 0.89 | 0.006 | 0.0034 | 0.037 | 0.004 | 0.016 | 0.083 | 0.008 | — | — | — | — | — | — | 0.240 |
| 23 | 0.075 | 0.33 | 0.89 | 0.006 | 0.0034 | 0.037 | 0.004 | 0.016 | 0.083 | 0.008 | — | — | — | — | — | — | 0.240 |
| 24 | 0.059 | 0.17 | 0.98 | 0.023 | 0.0019 | 0.029 | 0.0024 | 0.075 | 0.007 | 0.015 | — | — | — | — | — | — | 0.224 |
| 25 | 0.059 | 0.17 | 0.98 | 0.023 | 0.0019 | 0.029 | 0.0024 | 0.075 | 0.007 | 0.015 | — | — | — | — | — | — | 0.224 |
| 26 | 0.124 | 0.05 | 0.34 | 0.048 | 0.012 | 0.067 | 0.0031 | 0.011 | 0.049 | 0.028 | 0.23 | — | — | — | — | — | 0.236 |
| 27 | 0.124 | 0.05 | 0.34 | 0.048 | 0.012 | 0.067 | 0.0031 | 0.011 | 0.049 | 0.028 | 0.23 | — | — | — | — | — | 0.236 |
| 28 | 0.062 | 0.13 | 1.34 | 0.037 | 0.017 | 0.031 | 0.0052 | 0.056 | 0.146 | 0.018 | — | — | — | — | — | — | 0.315 |
| 29 | 0.062 | 0.13 | 1.34 | 0.037 | 0.017 | 0.031 | 0.0052 | 0.056 | 0.146 | 0.018 | — | — | — | — | — | — | 0.315 |
| 30 | 0.062 | 0.13 | 1.34 | 0.037 | 0.017 | 0.031 | 0.0052 | 0.056 | 0.146 | 0.018 | — | — | — | — | — | — | 0.315 |
| 31 | 0.070 | 0.26 | 1.97 | 0.009 | 0.0005 | 0.094 | 0.0049 | 0.022 | 0.028 | 0.148 | — | — | — | — | — | — | 0.404 |
| 32 | 0.070 | 0.26 | 1.97 | 0.009 | 0.0005 | 0.094 | 0.0049 | 0.022 | 0.028 | 0.148 | — | — | — | — | — | — | 0.404 |
| 33 | 0.070 | 0.26 | 1.97 | 0.009 | 0.0005 | 0.094 | 0.0049 | 0.022 | 0.028 | 0.148 | — | — | — | — | — | — | 0.404 |

The balance of chemical composition includes Fe and incidental impurities.

Ceq = C + Mn/6 + (Cr + Mo + V)/5 + (Cu + Ni)/15

TABLE 2

| No. | Hot rolling step | | | | | First cooling step | | |
|---|---|---|---|---|---|---|---|---|
| | Heating temperature (° C.) | Rough rolling delivery temperature (° C.) | Finish rolling start temperature (° C.) | Finish rolling delivery temperature (° C.) | Total rolling reduction ratio in finish rolling (%) | Average cooling rate at thickness center (° C./s) | Cooling stop temperature at thickness center (° C.) | Cooling stop temperature at surface (° C.) |
| 1 | 1200 | 1010 | 920 | 810 | 64 | 47 | 580 | 390 |
| 2 | 1250 | 990 | 910 | 790 | 65 | 65 | 570 | 260 |
| 3 | 1200 | 1150 | 900 | 820 | 68 | 8 | 580 | 420 |
| 4 | 1250 | 1020 | 890 | 780 | 71 | 38 | 560 | 320 |
| 5 | 1250 | 1000 | 930 | 770 | 66 | 33 | 680 | 460 |
| 6 | 1250 | 960 | 910 | 800 | 64 | 55 | 530 | 200 |
| 7 | 1200 | 980 | 940 | 790 | 73 | 56 | 610 | 270 |
| 8 | 1250 | 1080 | 920 | 840 | 70 | 59 | 570 | 220 |
| 9 | 1250 | 920 | 830 | 760 | 65 | 24 | 600 | 430 |
| 10 | 1200 | 970 | 910 | 790 | 70 | 40 | 560 | 400 |
| 11 | 1200 | 940 | 900 | 750 | 61 | 18 | 580 | 310 |
| 12 | 1200 | 990 | 820 | 800 | 74 | 24 | 590 | 340 |
| 13 | 1200 | 1020 | 910 | 810 | 62 | 39 | 570 | 280 |
| 14 | 1250 | 1100 | 890 | 820 | 66 | 28 | 620 | 430 |
| 15 | 1200 | 1080 | 880 | 810 | 68 | 14 | 630 | 400 |
| 16 | 1150 | 960 | 820 | 790 | 67 | 47 | 560 | 270 |
| 17 | 1200 | 950 | 850 | 770 | 69 | 51 | 580 | 300 |
| 18 | 1150 | 1010 | 940 | 790 | 62 | 34 | 590 | 320 |
| 19 | 1200 | 1090 | 880 | 800 | 65 | 67 | 570 | 280 |
| 20 | 1200 | 970 | 910 | 790 | 66 | 42 | 580 | 330 |
| 21 | 1200 | 1050 | 890 | 830 | 61 | 37 | 560 | 300 |
| 22 | 1200 | 950 | 820 | 760 | 72 | 18 | 630 | 390 |
| 23 | 1150 | 960 | 830 | 780 | 69 | 46 | 610 | 410 |
| 24 | 1150 | 1070 | 830 | 760 | 65 | 29 | 590 | 290 |
| 25 | 1250 | 920 | 850 | 770 | 62 | 7 | 610 | 320 |
| 26 | 1200 | 960 | 810 | 760 | 70 | 24 | 590 | 300 |
| 27 | 1350 | 1020 | 860 | 800 | 69 | 22 | 580 | 380 |
| 28 | 1200 | 940 | 830 | 770 | 65 | 31 | 600 | 290 |
| 29 | 1200 | 880 | 840 | 770 | 72 | 46 | 580 | 260 |
| 30 | 1250 | 940 | 790 | 750 | 66 | 35 | 550 | 270 |
| 31 | 1150 | 950 | 880 | 830 | 67 | 19 | 620 | 350 |
| 32 | 1200 | 1000 | 810 | 730 | 63 | 28 | 560 | 420 |
| 33 | 1200 | 1050 | 930 | 830 | 56 | 25 | 570 | 400 |

TABLE 2-continued

| No. | Time interval between end of first cooling step and start of second cooling step (s) | Second cooling step: Average cooling rate at thickness center (° C./s) | Second cooling step: Cooling stop temperature at thickness center (° C.) | Second cooling step: Cooling stop temperature at surface (° C.) | Coiling step Coiling temperature (° C.) | Final thickness (mm) | Remarks |
|---|---|---|---|---|---|---|---|
| 1 | 16 | 14 | 490 | 220 | 470 | 25 | Invention example |
| 2 | 8 | 17 | 510 | 250 | 490 | 20 | Comparative example |
| 3 | 13 | 22 | 520 | 310 | 490 | 25 | Comparative example |
| 4 | 15 | 16 | 470 | 170 | 560 | 35 | Invention example |
| 5 | 18 | 7 | 570 | 200 | 550 | 16 | Comparative example |
| 6 | 10 | 13 | 480 | 190 | 470 | 30 | Comparative example |
| 7 | 17 | 25 | 540 | 180 | 510 | 25 | Invention example |
| 8 | 11 | 29 | 490 | 240 | 460 | 35 | Comparative example |
| 9 | 23 | 13 | 510 | 220 | 480 | 20 | Comparative example |
| 10 | 4 | 19 | 460 | 190 | 430 | 25 | Comparative example |
| 11 | 15 | 20 | 520 | 280 | 500 | 20 | Invention example |
| 12 | 8 | 34 | 470 | 190 | 460 | 28 | Comparative example |
| 13 | 18 | 3 | 530 | 300 | 510 | 20 | Comparative example |
| 14 | 10 | 8 | 580 | 320 | 560 | 22 | Invention example |
| 15 | 16 | 11 | 620 | 360 | 590 | 19 | Comparative example |
| 16 | 9 | 23 | 410 | 120 | 390 | 25 | Comparative example |
| 17 | 11 | 20 | 460 | 140 | 450 | 25 | Comparative example |
| 18 | 19 | 17 | 490 | 170 | 470 | 20 | Invention example |
| 19 | 10 | 38 | 460 | 180 | 500 | 25 | Comparative example |
| 20 | 11 | 20 | 460 | 220 | 440 | 28 | Invention example |
| 21 | 15 | 27 | 480 | 160 | 450 | 25 | Invention example |
| 22 | 13 | 16 | 570 | 280 | 550 | 25 | Invention example |
| 23 | 9 | 24 | 500 | 200 | 480 | 25 | Invention example |
| 24 | 16 | 9 | 560 | 250 | 570 | 20 | Invention example |
| 25 | 14 | 4 | 580 | 260 | 560 | 22 | Comparative example |
| 26 | 11 | 10 | 550 | 230 | 540 | 25 | Invention example |
| 27 | 15 | 8 | 580 | 250 | 560 | 25 | Comparative example |
| 28 | 8 | 15 | 500 | 220 | 480 | 20 | Invention example |
| 29 | 10 | 14 | 470 | 190 | 450 | 20 | Comparative example |
| 30 | 9 | 22 | 490 | 210 | 470 | 20 | Comparative example |
| 31 | 19 | 11 | 490 | 260 | 480 | 19 | Invention example |
| 32 | 11 | 18 | 510 | 310 | 500 | 19 | Comparative example |
| 33 | 20 | 16 | 540 | 330 | 520 | 19 | Comparative example |

TABLE 3

| No. | Hot-rolled steel sheet: Steel microstructure at thickness center: F fraction (%) | B fraction (%) | (F + B) fraction (%) | Type of balance | Average grain size (μm) | Dislocation density ($\times 10^{14} m^{-2}$) | Steel microstructure at 0.1 mm depth below surface: F fraction (%) | B fraction (%) | (F + B) fraction (%) | Type of balance | Average grain size (μm) | Dislocation density ($\times 10^{14} m^{-2}$) |
|---|---|---|---|---|---|---|---|---|---|---|---|---|
| 1 | 38 | 60 | 98 | P, M | 6.6 | 6.4 | 13 | 84 | 97 | M | 5.1 | 6.9 |
| 2 | 11 | 85 | 96 | M | 4.9 | 5.2 | 4 | 74 | 78 | M | 4.7 | 17.0 |
| 3 | 59 | 37 | 96 | P | 10.2 | 2.4 | 42 | 56 | 98 | P, M | 7.3 | 3.1 |
| 4 | 23 | 76 | 99 | P, M | 5.5 | 3.9 | 18 | 80 | 98 | M | 5.2 | 5.0 |
| 5 | 64 | 34 | 98 | P | 9.5 | 2.2 | 55 | 42 | 97 | P, M | 8.5 | 5.5 |
| 6 | 8 | 89 | 97 | M | 6.8 | 5.4 | 0 | 75 | 75 | M | 5.8 | 7.4 |
| 7 | 22 | 74 | 96 | M | 7.0 | 4.5 | 8 | 88 | 96 | M | 6.1 | 6.3 |
| 8 | 10 | 86 | 96 | M | 5.2 | 5.9 | 3 | 87 | 90 | M | 4.7 | 7.2 |
| 9 | 25 | 73 | 98 | M | 9.6 | 2.3 | 12 | 85 | 97 | M | 7.4 | 3.3 |
| 10 | 30 | 69 | 99 | M | 6.1 | 5.3 | 9 | 90 | 99 | M | 5.6 | 14.0 |
| 11 | 42 | 53 | 95 | P, M | 5.9 | 4.1 | 17 | 81 | 98 | M | 5.5 | 5.8 |
| 12 | 16 | 82 | 98 | P, M | 6.2 | 4.5 | 8 | 74 | 82 | M | 5.8 | 5.6 |
| 13 | 44 | 53 | 97 | P, M | 9.1 | 2.6 | 27 | 71 | 98 | M | 8.0 | 4.3 |
| 14 | 40 | 58 | 98 | P, M | 6.6 | 4.2 | 22 | 77 | 99 | M | 5.9 | 5.8 |
| 15 | 39 | 57 | 96 | P, M | 9.5 | 3.0 | 25 | 74 | 99 | M | 7.5 | 4.3 |
| 16 | 6 | 89 | 95 | M | 5.1 | 6.3 | 3 | 73 | 76 | M | 4.8 | 9.3 |
| 17 | 12 | 86 | 98 | M | 5.9 | 4.3 | 8 | 72 | 80 | M | 4.7 | 9.1 |
| 18 | 33 | 63 | 96 | P, M | 6.2 | 6.6 | 22 | 74 | 96 | M | 5.1 | 8.1 |
| 19 | 15 | 76 | 91 | P, M | 5.3 | 7.8 | 8 | 77 | 85 | M | 4.8 | 11.0 |
| 20 | 15 | 82 | 97 | M, A | 5.4 | 5.7 | 13 | 84 | 97 | M, A | 5.2 | 7.3 |
| 21 | 25 | 73 | 98 | M, A | 6.0 | 4.1 | 19 | 77 | 96 | M, A | 5.3 | 6.2 |
| 22 | 30 | 69 | 99 | M | 5.8 | 5.5 | 5 | 94 | 99 | M | 5.9 | 6.3 |
| 23 | 24 | 74 | 98 | M | 6.9 | 4.3 | 11 | 86 | 97 | M | 5.7 | 5.9 |
| 24 | 18 | 81 | 99 | M | 7.3 | 4.9 | 13 | 85 | 98 | M | 6.8 | 8.0 |
| 25 | 60 | 36 | 96 | P | 10.5 | 2.6 | 56 | 41 | 97 | P, M | 9.2 | 4.0 |

TABLE 3-continued

| | | | | | | | | | | | | |
|---|---|---|---|---|---|---|---|---|---|---|---|---|
| 26 | 45 | 54 | 99 | P | 5.2 | 4.5 | 21 | 75 | 96 | M | 4.8 | 5.4 |
| 27 | 18 | 78 | 96 | P | 10.3 | 2.1 | 15 | 84 | 99 | M | 9.5 | 6.0 |
| 28 | 36 | 62 | 98 | P | 6.2 | 6.1 | 18 | 78 | 96 | M | 5.4 | 5.1 |
| 29 | 48 | 50 | 98 | P | 6.0 | 4.7 | 4 | 93 | 97 | M | 5.9 | 12.0 |
| 30 | 47 | 50 | 97 | P, M | 5.9 | 5.2 | 7 | 92 | 99 | M | 5.1 | 5.2 |
| 31 | 11 | 88 | 99 | P | 5.5 | 4.1 | 26 | 72 | 98 | M | 4.8 | 5.4 |
| 32 | 60 | 37 | 97 | M | 5.6 | 6.2 | 37 | 61 | 98 | M | 5.3 | 4.9 |
| 33 | 43 | 53 | 96 | M | 9.4 | 3.3 | 22 | 77 | 99 | M | 9.2 | 5.0 |

| | Hot-rolled steel sheet | | | | | |
|---|---|---|---|---|---|---|
| | Steel microstructure at 0.1 mm depth below surface | | | SSC resistance | | |
| No. | Maximum low angle grain boundary density ($\times 10^6 m^{-1}$) | Mechanical properties Yield strength (MPa) | Crack | Maximum depth of pitting corrosions (μm) | Maximum (depth/width) of pitting corrosions | Remarks |
| 1 | 1.1 | 504 | No | 114 | 1.4 | Invention example |
| 2 | 2.0 | 471 | Yes | 289 | 2.8 | Comparative example |
| 3 | 1.0 | 377 | No | 155 | 1.7 | Comparative example |
| 4 | 1.2 | 423 | No | 96 | 1.2 | Invention example |
| 5 | 0.87 | 326 | No | 88 | 1.4 | Comparative example |
| 6 | 1.9 | 490 | No | 303 | 4.1 | Comparative example |
| 7 | 1.2 | 425 | No | 160 | 2.2 | Invention example |
| 8 | 2.5 | 488 | Yes | 277 | 3.9 | Comparative example |
| 9 | 0.75 | 332 | No | 123 | 1.8 | Comparative example |
| 10 | 1.9 | 461 | No | 312 | 3.5 | Comparative example |
| 11 | 1.0 | 414 | No | 74 | 1.1 | Invention example |
| 12 | 2.4 | 449 | Yes | 244 | 4.6 | Comparative example |
| 13 | 1.3 | 348 | No | 86 | 1.2 | Comparative example |
| 14 | 1.1 | 422 | No | 138 | 1.7 | Invention example |
| 15 | 0.89 | 342 | No | 86 | 1.4 | Comparative example |
| 16 | 1.8 | 503 | Yes | 293 | 3.7 | Comparative example |
| 17 | 2.1 | 426 | Yes | 276 | 2.4 | Comparative example |
| 18 | 1.1 | 494 | No | 97 | 2.2 | Invention example |
| 19 | 2.6 | 526 | Yes | 295 | 4.2 | Comparative example |
| 20 | 0.88 | 470 | No | 131 | 1.3 | Invention example |
| 21 | 0.91 | 415 | No | 77 | 1.9 | Invention example |
| 22 | 1.0 | 462 | No | 115 | 2.0 | Invention example |
| 23 | 1.2 | 420 | No | 154 | 2.2 | Invention example |
| 24 | 0.10 | 409 | No | 160 | 2.4 | Invention example |
| 25 | 0.88 | 345 | No | 101 | 1.7 | Comparative example |
| 26 | 0.99 | 417 | No | 110 | 1.9 | Invention example |
| 27 | 1.1 | 341 | No | 96 | 2.4 | Comparative example |
| 28 | 1.2 | 468 | No | 118 | 2.4 | Invention example |
| 29 | 1.5 | 412 | Yes | 115 | 3.1 | Comparative example |
| 30 | 1.5 | 455 | No | 261 | 2.6 | Comparative example |
| 31 | 1.0 | 413 | No | 239 | 2.9 | Invention example |
| 32 | 1.7 | 490 | Yes | 177 | 3.5 | Comparative example |
| 33 | 0.89 | 377 | No | 210 | 2.6 | Comparative example |

F: ferrite,
B: bainite,
P: pearlite,
M: martensite,
A: austenite

TABLE 4

| | Pipe-making step | | Electric resistance welded pipe | | | | | | | |
|---|---|---|---|---|---|---|---|---|---|---|
| | Electric resistance welding | Sizing step | | | Steel microstructure at wall-thickness center | | | | | |
| | | | Dimensions | | | | | | Average | |
| No. | step Amount of upset (%) | Diameter reduction ratio (%) | Outer diameter (mm) | Wall thickness (mm) | F fraction (%) | B fraction (%) | (F + B) fraction (%) | Type of balance | grain size (μm) | Dislocation density ($\times 10^{14} m^{-2}$) |
| 1 | 55 | 0.90 | 600 | 25 | 34 | 65 | 99 | P, M | 6.8 | 8.2 |
| 2 | 28 | 3.8 | 600 | 20 | 15 | 83 | 98 | M | 5.1 | 8.5 |
| 3 | 66 | 1.1 | 600 | 25 | 62 | 37 | 99 | P | 9.4 | 3.8 |
| 4 | 61 | 1.9 | 700 | 35 | 26 | 71 | 97 | P, M | 6.1 | 5.4 |
| 5 | 49 | 1.3 | 700 | 16 | 71 | 27 | 98 | P | 9.8 | 4.2 |
| 6 | 84 | 2.1 | 700 | 30 | 5 | 94 | 99 | M | 7.4 | 8.2 |

TABLE 4-continued

| | | | | | | | | | | |
|---|---|---|---|---|---|---|---|---|---|---|
| 7 | 25 | 2.7 | 600 | 25 | 18 | 79 | 97 | M | 7.1 | 6.3 |
| 8 | 51 | 1.0 | 700 | 35 | 7 | 92 | 99 | M | 5.5 | 7.5 |
| 9 | 44 | 2.0 | 600 | 20 | 27 | 71 | 98 | M | 10.1 | 4.1 |
| 10 | 48 | 3.2 | 650 | 25 | 24 | 71 | 95 | M | 6.0 | 7.9 |
| 11 | 88 | 3.9 | 600 | 20 | 44 | 52 | 96 | P, M | 6.3 | 5.2 |
| 12 | 38 | 2.6 | 600 | 28 | 17 | 82 | 99 | P, M | 6.3 | 6.6 |
| 13 | 45 | 0.79 | 600 | 20 | 43 | 53 | 96 | P, M | 9.2 | 4.0 |
| 14 | 66 | 2.6 | 600 | 22 | 35 | 64 | 99 | P, M | 6.4 | 6.3 |
| 15 | 77 | 1.8 | 600 | 19 | 42 | 56 | 98 | P, M | 9.6 | 3.9 |
| 16 | 46 | 2.6 | 600 | 25 | 5 | 91 | 96 | M | 5.0 | 7.7 |
| 17 | 66 | 2.2 | 600 | 25 | 10 | 89 | 99 | M | 5.8 | 5.2 |
| 18 | 67 | 2.8 | 650 | 20 | 30 | 69 | 99 | P, M | 6.0 | 7.1 |
| 19 | 69 | 1.9 | 650 | 25 | 18 | 70 | 88 | P, M | 5.5 | 9.5 |
| 20 | 67 | 3.1 | 700 | 28 | 14 | 83 | 97 | M, A | 5.4 | 6.9 |
| 21 | 104 | 3.1 | 600 | 25 | 22 | 74 | 96 | M, A | 6.2 | 9.4 |
| 22 | 70 | 1.3 | 600 | 25 | 31 | 66 | 97 | M | 5.5 | 7.2 |
| 23 | 72 | 4.5 | 600 | 25 | 22 | 77 | 99 | M | 6.7 | 8.9 |
| 24 | 79 | 2.3 | 700 | 20 | 15 | 83 | 98 | M | 7.1 | 6.8 |
| 25 | 32 | 3.7 | 600 | 22 | 59 | 40 | 99 | P | 9.8 | 4.1 |
| 26 | 55 | 1.9 | 600 | 25 | 46 | 52 | 98 | P | 5.5 | 5.2 |
| 27 | 61 | 3.2 | 600 | 25 | 22 | 77 | 99 | P | 10.4 | 3.2 |
| 28 | 49 | 2.6 | 600 | 20 | 34 | 64 | 98 | P | 6.3 | 6.8 |
| 29 | 72 | 3.4 | 600 | 20 | 48 | 50 | 98 | P | 6.0 | 5.4 |
| 30 | 35 | 2.1 | 600 | 20 | 46 | 51 | 97 | P, M | 5.6 | 6.0 |
| 31 | 29 | 1.8 | 550 | 19 | 9 | 90 | 99 | P | 5.5 | 5.1 |
| 32 | 44 | 3.3 | 550 | 19 | 55 | 41 | 96 | M | 5.7 | 6.7 |
| 33 | 38 | 2.0 | 550 | 19 | 40 | 55 | 95 | M | 9.3 | 3.7 |

| | Electric resistance welded pipe | | | | | | |
|---|---|---|---|---|---|---|---|
| | Steel microstructure at 0.1 mm depth below inner surface of pipe | | | | | | |
| No. | F fraction (%) | B fraction (%) | (F + B) fraction (%) | Type of balance | Average grain size (μm) | Dislocation density ($\times 10^{14} m^{-2}$) | Maximum low angle grain boundary density ($\times 10^{6} m^{-1}$) |
| 1 | 7 | 91 | 98 | M | 5.0 | 8.7 | 1.2 |
| 2 | 6 | 70 | 76 | M | 4.8 | 24.0 | 2.6 |
| 3 | 34 | 62 | 96 | P, M | 7.7 | 4.4 | 1.1 |
| 4 | 11 | 85 | 96 | M | 5.5 | 7.6 | 1.3 |
| 5 | 63 | 32 | 95 | P, M | 8.1 | 7.7 | 1.0 |
| 6 | 0 | 71 | 71 | M | 5.2 | 9.6 | 2.8 |
| 7 | 15 | 84 | 99 | M | 6.5 | 8.8 | 1.4 |
| 8 | 2 | 82 | 84 | M | 4.4 | 8.7 | 2.7 |
| 9 | 11 | 85 | 96 | M | 7.4 | 5.4 | 1.0 |
| 10 | 16 | 81 | 97 | M | 5.9 | 20.0 | 2.3 |
| 11 | 22 | 75 | 97 | M | 5.1 | 7.6 | 1.1 |
| 12 | 4 | 72 | 76 | M | 5.3 | 9.2 | 2.5 |
| 13 | 24 | 75 | 99 | M | 8.1 | 5.6 | 1.4 |
| 14 | 21 | 75 | 96 | M | 6.0 | 7.0 | 1.2 |
| 15 | 26 | 72 | 98 | M | 7.7 | 4.9 | 1.0 |
| 16 | 2 | 70 | 72 | M | 4.7 | 9.7 | 2.8 |
| 17 | 7 | 74 | 81 | M | 4.9 | 9.8 | 2.9 |
| 18 | 22 | 77 | 99 | M | 5.0 | 9.6 | 1.3 |
| 19 | 8 | 75 | 83 | M | 4.8 | 16.0 | 2.8 |
| 20 | 13 | 83 | 96 | M, A | 5.6 | 7.4 | 1.0 |
| 21 | 16 | 81 | 97 | M, A | 5.0 | 15.0 | 3.0 |
| 22 | 6 | 93 | 99 | M | 5.6 | 8.5 | 0.11 |
| 23 | 7 | 92 | 99 | M | 6.0 | 22.0 | 1.9 |
| 24 | 16 | 81 | 97 | M | 6.4 | 8.8 | 1.3 |
| 25 | 50 | 46 | 96 | P, M | 9.5 | 5.1 | 1.2 |
| 26 | 24 | 72 | 96 | M | 4.9 | 6.7 | 1.1 |
| 27 | 16 | 80 | 96 | M | 9.7 | 6.6 | 1.0 |
| 28 | 19 | 76 | 95 | M | 5.3 | 6.1 | 1.3 |
| 29 | 5 | 94 | 99 | M | 5.6 | 16.0 | 1.6 |
| 30 | 8 | 90 | 98 | M | 5.0 | 6.7 | 1.7 |
| 31 | 22 | 75 | 97 | M | 5.0 | 6.3 | 1.2 |
| 32 | 39 | 60 | 99 | M | 5.2 | 6.5 | 1.6 |
| 33 | 20 | 79 | 99 | M | 9.4 | 6.9 | 0.94 |

TABLE 4-continued

| | Electric resistance welded pipe | | | | |
|---|---|---|---|---|---|
| | | SSC resistance | | | |
| No. | Mechanical properties Yield strength (MPa) | Crack | Maximum depth of pitting corrosions (μm) | Maximum (depth/width) of pitting corrosions | Remarks |
| 1 | 563 | No | 135 | 1.8 | Invention example |
| 2 | 575 | Yes | 309 | 3.5 | Comparative example |
| 3 | 388 | No | 121 | 1.3 | Comparative example |
| 4 | 462 | No | 128 | 2.0 | Invention example |
| 5 | 381 | No | 97 | 1.4 | Comparative example |
| 6 | 569 | Yes | 314 | 4.0 | Comparative example |
| 7 | 485 | No | 151 | 2.5 | Invention example |
| 8 | 528 | Yes | 234 | 3.8 | Comparative example |
| 9 | 394 | No | 177 | 1.9 | Comparative example |
| 10 | 560 | Yes | 289 | 4.4 | Comparative example |
| 11 | 467 | No | 110 | 1.7 | Invention example |
| 12 | 515 | Yes | 277 | 3.9 | Comparative example |
| 13 | 391 | No | 103 | 1.6 | Comparative example |
| 14 | 503 | No | 218 | 2.5 | Invention example |
| 15 | 387 | No | 136 | 1.6 | Comparative example |
| 16 | 549 | Yes | 334 | 4.1 | Comparative example |
| 17 | 447 | Yes | 320 | 3.5 | Comparative example |
| 18 | 522 | No | 220 | 1.8 | Invention example |
| 19 | 584 | Yes | 289 | 4.5 | Comparative example |
| 20 | 516 | No | 118 | 1.9 | Invention example |
| 21 | 587 | Yes | 230 | 3.7 | Comparative example |
| 22 | 530 | No | 182 | 2.7 | Invention example |
| 23 | 565 | Yes | 301 | 4.4 | Comparative example |
| 24 | 514 | No | 112 | 1.9 | Invention example |
| 25 | 390 | No | 153 | 1.6 | Comparative example |
| 26 | 448 | No | 222 | 1.5 | Invention example |
| 27 | 378 | No | 189 | 1.7 | Comparative example |
| 28 | 519 | No | 98 | 2.7 | Invention example |
| 29 | 463 | Yes | 107 | 3.3 | Comparative example |
| 30 | 488 | Yes | 169 | 3.1 | Comparative example |
| 31 | 441 | No | 177 | 2.4 | Invention example |
| 32 | 517 | No | 268 | 3.9 | Comparative example |
| 33 | 393 | No | 172 | 1.7 | Comparative example |

F: ferrite,
B: bainite,
P: pearlite,
M: martensite,
A: austenite

In Tables 3 and 4, the hot rolled steel sheet Nos. 1, 4, 7, 11, 14, 18, 20 to 24, 26, 28, and 31 and the electric resistance welded steel pipe Nos. 1, 4, 7, 11, 14, 18, 20, 22, 24, 26, 28, and 31 were Invention Examples, while the hot rolled steel sheet Nos. 2, 3, 5, 6, 8 to 10, 12, 13, 15 to 17, 19, 25, 27, 29, 30, 32, and 33 and the electric resistance welded steel pipe Nos. 2, 3, 5, 6, 8 to 10, 12, 13, 15 to 17, 19, 21, 23, 25, 27, 29, 30, 32, and 33 were Comparative Examples.

In the steel microstructure of any of the hot rolled steel sheets of Invention Examples at the thickness center, the volume fraction of bainite was 50% or more, the total volume fraction of ferrite and bainite was 95% or more, with the balance including one or more selected from pearlite, martensite, and austenite, the average grain size was 9.0 μm or less, and the dislocation density was $1.0\times10^{14}$ $m^{-2}$ or more and $1.0\times10^{15}$ $m^{-2}$ or less. In the steel microstructure of any of the hot rolled steel sheets of Invention Examples at the 0.1-mm depth position below the surface of the sheet, the volume fraction of bainite was 70% or more, the total volume fraction of ferrite and bainite was 95% or more, with the balance including one or more selected from pearlite, martensite, and austenite, the average grain size was 9.0 μm or less, the dislocation density was $5.0\times10^{14}$ $m^{-2}$ or more and $1.0\times10^{15}$ $m^{-2}$ or less, and the maximum low angle grain boundary density was $1.4\times10^{6}$ $m^{-1}$ or less. The thicknesses of the hot rolled steel sheets of Invention Examples were 15 mm or more.

In the steel microstructure of the base metal zone of any of the electric resistance welded steel pipes of Invention Examples at the wall thickness center, the volume fraction of bainite was 50% or more, the total volume fraction of ferrite and bainite was 95% or more, with the balance including one or more selected from pearlite, martensite, and austenite, the average grain size was 9.0 μm or less, and the dislocation density was $2.0\times10^{14}$ $m^{-2}$ or more and $1.0\times10^{15}$ $m^{-2}$ or less. In the steel microstructure of the base metal zone of any of the electric resistance welded steel pipes of Invention Examples at the 0.1-mm depth position below the inner surface of the pipe, the volume fraction of bainite was 70% or more, the total volume fraction of ferrite and bainite was 95% or more, with the balance including one or more selected from pearlite, martensite, and austenite, the average grain size was 9.0 μm or less, the dislocation density was $6.0\times10^{14}$ $m^{-2}$ or more and $1.0\times10^{15}$ $m^{-2}$ or less, and the maximum low angle grain boundary density was $1.5\times10^{6}$ $m^{-1}$ or less. The wall thicknesses of the electric resistance welded steel pipes of Invention Examples were 15 mm or more.

All of the hot rolled steel sheets and electric resistance welded steel pipes prepared in Invention Examples had a yield strength of 400 MPa or more in any of the tensile tests. Furthermore, in the four-point bending corrosion test, cracking did not occur. The depths of the pitting corrosions were less than 250 μm, and the (depth/width) ratio was less than 3.0.

In contrast, in the hot rolled steel sheet and the electric resistance welded steel pipe prepared in Comparative Example No. 2, where the average cooling rate at the thickness center of the sheet in the first cooling step was high, a large amount of martensite was formed in the surface of the steel sheet and the maximum low angle grain boundary density was increased. Consequently, the intended SSC resistance could not be achieved.

In the hot rolled steel sheet and the electric resistance welded steel pipe prepared in Comparative Example No. 3, where the average cooling rate at the thickness center of the sheet in the first cooling step was low, the ferrite fractions at the surface and thickness center of the steel sheet were increased and, consequently, a microstructure having the bainite fraction intended in accordance with aspects of the present invention could not be formed. Furthermore, ferrite and bainite became coarsened at the thickness center, and a steel microstructure having the average grain size intended in accordance with aspects of the present invention could not be formed. As a result, the intended yield strength could not be achieved.

In the hot rolled steel sheet and the electric resistance welded steel pipe prepared in Comparative Example No. 5, where the cooling stop temperature at the thickness center of the sheet in the first cooling step was high, the cooling stop temperature at the surface of the sheet was also high, the ferrite fractions at the surface and thickness center of the steel sheet were increased, and a microstructure having the bainite fraction intended in accordance with aspects of the present invention could not be formed. Furthermore, ferrite and bainite became coarsened at the thickness center and, consequently, a steel microstructure having the average grain size intended in accordance with aspects of the present invention could not be formed. As a result, the intended yield strength could not be achieved.

In the hot rolled steel sheet and the electric resistance welded steel pipe prepared in Comparative Example No. 6, where the cooling stop temperature at the thickness center of the sheet in the first cooling step was low, the cooling stop temperature at the surface of the sheet was also low, a large amount of martensite was formed in the surface of the steel sheet, and the maximum low angle grain boundary density was increased. Consequently, the intended SSC resistance could not be achieved.

In the hot rolled steel sheet and the electric resistance welded steel pipe prepared in Comparative Example No. 8, where the cooling stop temperature at the surface of the sheet in the first cooling step was low, a large amount of martensite was formed in the surface of the steel sheet and the maximum low angle grain boundary density was increased. Consequently, the intended SSC resistance could not be achieved.

In the hot rolled steel sheet and the electric resistance welded steel pipe prepared in Comparative Example No. 9, where the time interval between the end of the first cooling step and the start of the second cooling step was large, ferrite or bainite became coarsened at the thickness center. As a result, the intended yield strength could not be achieved.

In the hot rolled steel sheet and the electric resistance welded steel pipe prepared in Comparative Example No. 10, where the time interval between the end of the first cooling step and the start of the second cooling step was small, the dislocation density in the surface of the sheet was increased and the maximum low angle grain boundary density was increased. Consequently, the intended SSC resistance could not be achieved.

In the hot rolled steel sheet and the electric resistance welded steel pipe prepared in Comparative Example No. 12, where the average cooling rate at the thickness center of the sheet in the second cooling step was high, a large amount of martensite was formed in the surface of the steel sheet and the maximum low angle grain boundary density was increased. Consequently, the intended SSC resistance could not be achieved.

In the hot rolled steel sheet and the electric resistance welded steel pipe prepared in Comparative Example No. 13, where the average cooling rate at the thickness center of the sheet in the second cooling step was low, ferrite and bainite became coarsened at the thickness center, and a steel microstructure having the average grain size intended in accordance with aspects of the present invention could not be formed. As a result, the intended yield strength could not be achieved.

In the hot rolled steel sheet and the electric resistance welded steel pipe prepared in Comparative Example No. 15, where the cooling stop temperature at the thickness center of the sheet in the second cooling step was high, the cooling stop temperature at the surface of the sheet was also high, and ferrite and bainite became coarsened at the thickness center. Consequently, a steel microstructure having the average grain size intended in accordance with aspects of the present invention could not be formed. As a result, the intended yield strength could not be achieved.

In the hot rolled steel sheet and the electric resistance welded steel pipe prepared in Comparative Example No. 16, where the cooling stop temperature at the thickness center of the sheet in the second cooling step was low, the cooling stop temperature at the surface of the sheet was also low, a large amount of martensite was formed in the surface of the steel sheet, and the maximum low angle grain boundary density was increased. Consequently, the intended SSC resistance could not be achieved.

In the hot rolled steel sheet and the electric resistance welded steel pipe prepared in Comparative Example No. 17, where the average cooling rate at the surface of the sheet in the second cooling step was low, a large amount of martensite was formed in the surface of the steel sheet and the maximum low angle grain boundary density was increased. Consequently, the intended SSC resistance could not be achieved.

In the hot rolled steel sheet and the electric resistance welded steel pipe prepared in Comparative Example No. 19, where the average cooling rates at the thickness center of the sheet in the first and second cooling steps were high, a large amount of martensite was formed in the surface of the steel sheet and the maximum low angle grain boundary density was increased. Consequently, the intended SSC resistance could not be achieved.

In the electric resistance welded steel pipe prepared in Comparative Example No. 21, where the amount of upset in the electric resistance welding step was large, the dislocation density and maximum low angle grain boundary density at the inner surface of the pipe were increased. Consequently, the intended SSC resistance could not be achieved.

In the electric resistance welded steel pipe prepared in Comparative Example No. 23, where the diameter reduction ratio in the sizing step was high, the dislocation density and maximum low angle grain boundary density at the inner surface of the pipe were increased. Consequently, the intended SSC resistance could not be achieved.

In the hot rolled steel sheet and the electric resistance welded steel pipe prepared in Comparative Example No. 25, where the average cooling rates at the thickness center of the sheet in the first and second cooling steps were low, the ferrite fraction was increased at the surface and thickness center of the steel sheet, and a microstructure having the bainite fraction intended in accordance with aspects of the present invention could not be formed. Moreover, ferrite and bainite became coarsened at the thickness center, and a steel microstructure having the average grain size intended in accordance with aspects of the present invention could not be formed. As a result, the intended yield strength could not be achieved.

In the hot rolled steel sheet and the electric resistance welded steel pipe prepared in Comparative Example No. 27, where the heating temperature in the hot rolling step was high, a steel microstructure having the average grain size intended in accordance with aspects of the present invention could not be formed. As a result, the intended yield strength could not be achieved.

In the hot rolled steel sheet and the electric resistance welded steel pipe prepared in Comparative Example No. 29, where the rough rolling delivery temperature in the hot rolling step was low, the dislocation density in the surface of the sheet was increased and the maximum low angle grain boundary density was increased. Consequently, the intended SSC resistance could not be achieved.

In the hot rolled steel sheet and the electric resistance welded steel pipe prepared in Comparative Example No. 30, where the finish rolling start temperature in the hot rolling step was low, the maximum low angle grain boundary density in the surface of the sheet was increased. Consequently, the intended SSC resistance could not be achieved.

In the hot rolled steel sheet and the electric resistance welded steel pipe prepared in Comparative Example No. 32, where the finish rolling delivery temperature in the hot rolling step was low, the maximum low angle grain boundary density in the surface of the sheet was increased. Consequently, the intended SSC resistance could not be achieved.

In the hot rolled steel sheet and the electric resistance welded steel pipe prepared in Comparative Example No. 33, where the total rolling reduction ratio in the finish rolling of the hot rolling step was low, a steel microstructure having the average grain size intended in accordance with aspects of the present invention could not be formed. As a result, the intended yield strength could not be achieved.

REFERENCE SIGNS LIST

1 BASE METAL ZONE
2 WELD HEAT AFFECTED ZONE
3 MOLTEN AND SOLIDIFIED ZONE

The invention claimed is:

1. A hot rolled steel sheet, wherein:
in a steel microstructure of the hot rolled steel sheet at a center of the steel sheet in a thickness direction of the steel sheet,
a volume fraction of bainite is 50% or more,
a total volume fraction of ferrite and bainite is 95% or more,
with the balance being one or more selected from pearlite, martensite, and austenite,
an average grain size is 9.0 μm or less, and
a dislocation density is $1.0\times10^{14}$ $m^{-2}$ or more and $1.0\times10^{15}$ $m^{-2}$ or less;
in a steel microstructure of the hot rolled steel sheet at a position 0.1 mm below a surface of the steel sheet in a depth direction of the steel sheet,
a volume fraction of bainite is 70% or more,
a total volume fraction of ferrite and bainite is 95% or more,
with the balance being one or more selected from pearlite, martensite, and austenite,
an average grain size is 9.0 μm or less,
a dislocation density is $5.0\times10^{14}$ $m^{-2}$ or more and $1.0\times10^{15}$ $m^{-2}$ or less, and
a maximum low angle grain boundary density is $1.4\times10^{6}$ $m^{-1}$ or less; and
a thickness of the hot rolled steel sheet is 15 mm or more.

2. The hot rolled steel sheet according to claim 1, having a chemical composition containing, by mass,
C: 0.020% or more and 0.15% or less,
Si: 1.0% or less,
Mn: 0.30% or more and 2.0% or less,
P: 0.050% or less,
S: 0.020% or less,
Al: 0.005% or more and 0.10% or less,
N: 0.010% or less,
Nb: 0.15% or less,
V: 0.15% or less,
Ti: 0.15% or less, and
optionally one or more selected from Cr: 1.0% or less, Mo: 1.0% or less, Cu: 1.0% or less, Ni: 1.0% or less, Ca: 0.010% or less, and B: 0.010% or less,
with the balance being Fe and incidental impurities.

3. A method for producing the hot rolled steel sheet according to claim 1, the method comprising
a hot rolling step of hot rolling a steel material,
first and second cooling steps subsequent to the hot rolling step, and a step of performing coiling subsequent to the cooling steps, wherein:
in the hot rolling step,
after a temperature of the steel material has been increased to a heating temperature of 1100° C. or more and 1300° C. or less,
hot rolling is performed such that a rough rolling delivery temperature is 900° C. or more and 1100° C. or less, a finish rolling start temperature is 800° C. or more and 950° C. or less,
a finish rolling delivery temperature is 750° C. or more and 850° C. or less, and a total rolling reduction ratio during finish rolling is 60% or more;
in the first cooling step,
cooling is performed such that an average cooling rate at a thickness center of the steel sheet in a thickness direction of the steel sheet is 10° C./s or more and 60° C./s or less and a cooling stop temperature at the thickness center is 550° C. or more and 650° C. or less, and
such that a cooling stop temperature at a surface of the steel sheet is 250° C. or more and 450° C. or less;
a time interval between an end of the first cooling step and a start of the second cooling step is 5 s or more and 20 s or less; and
in the second cooling step,
cooling is performed such that an average cooling rate at the thickness center is cooled is 5° C./s or more and 30° C./s or less and a cooling stop temperature at the thickness center is 450° C. or more and 600° C. or less, and such that a cooling stop temperature at the surface of the steel sheet is 150° C. or more and 350° C. or less.

4. A method for producing the hot rolled steel sheet according to claim 2, the method comprising a hot rolling step of hot rolling a steel material of claim 2, first and second cooling steps subsequent to the hot rolling step, and a step of performing coiling subsequent to the cooling steps, wherein:

in the hot rolling step, after a temperature of the steel material has been increased to a heating temperature of 1100° C. or more and 1300° C. or less, hot rolling is performed such that a rough rolling delivery temperature is 900° C. or more and 1100° C. or less, a finish rolling start temperature is 800° C. or more and 950° C. or less, a finish rolling delivery temperature is 750° C. or more and 850° C. or less, and a total rolling reduction ratio during finish rolling is 60% or more;

in the first cooling step, cooling is performed such that an average cooling rate at a thickness center of the steel sheet in a thickness direction of the steel sheet is 10° C./s or more and 60° C./s or less and a cooling stop temperature at the thickness center is 550° C. or more and 650° C. or less, and such that a cooling stop temperature at a surface of the steel sheet is 250° C. or more and 450° C. or less;

a time interval between an end of the first cooling step and a start of the second cooling step is 5 s or more and 20 s or less; and in the second cooling step, cooling is performed such that an average cooling rate at the thickness center is cooled is 5° C./s or more and 30° C./s or less and a cooling stop temperature at the thickness center is 450° C. or more and 600° C. or less, and such that a cooling stop temperature at the surface of the steel sheet is 150° C. or more and 350° C. or less.

5. An electric resistance welded steel pipe comprising a base metal zone and an electric resistance welded zone, wherein:

in a steel microstructure of the base metal zone at a center of the base metal zone in a wall-thickness direction of the electric resistance welded steel pipe, a volume fraction of bainite is 50% or more, a total volume fraction of ferrite and bainite is 95% or more, with the balance being one or more selected from pearlite, martensite, and austenite, an average grain size is 9.0 μm or less, and a dislocation density is $2.0\times10^{14}$ $m^{-2}$ or more and $1.0\times10^{15}$ $m^{-2}$ or less;

in a steel microstructure of the base metal zone at a position 0.1 mm below an inner surface of the high strength-electric resistance welded steel pipe in a depth direction of the steel pipe, a volume fraction of bainite is 70% or more, a total volume fraction of ferrite and bainite is 95% or more, with the balance being one or more selected from pearlite, martensite, and austenite, an average grain size is 9.0 μm or less, a dislocation density is $6.0\times10^{14}$ $m^{-2}$ or more and $1.0\times10^{15}$ $m^{-2}$ or less, and a maximum low angle grain boundary density is $1.5\times10^{6}$ $m^{-1}$ or less; and a wall thickness of the base metal zone is 15 mm or more.

6. The electric resistance welded steel pipe according to claim 5, wherein the base metal zone has a chemical composition containing, by mass, C: 0.020% or more and 0.15% or less, Si: 1.0% or less, Mn: 0.30% or more and 2.0% or less, P: 0.050% or less, S: 0.020% or less, Al: 0.005% or more and 0.10% or less, N: 0.010% or less, Nb: 0.15% or less, V: 0.15% or less, Ti: 0.15% or less, and optionally one or more selected from Cr: 1.0% or less, Mo: 1.0% or less, Cu: 1.0% or less, Ni: 1.0% or less, Ca: 0.010% or less, and B: 0.010% or less, with the balance being Fe and incidental impurities.

7. A method for producing an electric resistance welded steel pipe, the method comprising forming the hot rolled steel sheet according to claim 1 into a cylindrical body by cold roll forming, butting edges of the cylindrical body in a circumferential direction of the cylindrical body to each other, and joining the edges to each other by electric resistance welding, wherein:

an amount of upset in the electric resistance welding is 20% or more and 100% or less of the thickness of the hot rolled steel sheet, and in a sizing step conducted subsequent to the electric resistance welding, diameter reduction is performed such that a perimeter of the steel pipe reduces at a rate of 0.5% or more and 4.0% or less.

8. A method for producing an electric resistance welded steel pipe, the method comprising forming the hot rolled steel sheet according to claim 2 into a cylindrical body by cold roll forming, butting edges of the cylindrical body in a circumferential direction of the cylindrical body to each other, and joining the edges to each other by electric resistance welding, wherein:

an amount of upset in the electric resistance welding is 20% or more and 100% or less of the thickness of the hot rolled steel sheet, and in a sizing step conducted subsequent to the electric resistance welding, diameter reduction is performed such that a perimeter of the steel pipe reduces at a rate of 0.5% or more and 4.0% or less.

* * * * *